US010486206B2

(12) United States Patent
Carson

(10) Patent No.: US 10,486,206 B2
(45) Date of Patent: Nov. 26, 2019

(54) APPARATUS, SYSTEM AND METHOD FOR CLEANING INNER SURFACES OF TUBING WITH BENDS

(71) Applicant: 1863815 Ontario Limited, Point Edward (CA)

(72) Inventor: Glenn L. Carson, Point Edward (CA)

(73) Assignee: 1863815 Ontario Limited, Point Edward, Ontario ( * ) Notice: Subject to any disclaimer, the term of this patent is extended or adjusted under 35 U.S.C. 154(b) by 647 days.

(21) Appl. No.: 15/155,347

(22) Filed: May 16, 2016

(65) Prior Publication Data

US 2016/0354814 A1 Dec. 8, 2016

Related U.S. Application Data

(60) Provisional application No. 62/291,112, filed on Feb. 4, 2016, provisional application No. 62/170,842, filed on Jun. 4, 2015.

(51) Int. Cl.

| | |
|---|---|
| ***E21B 17/00*** | (2006.01) |
| ***B08B 9/043*** | (2006.01) |
| ***F28G 1/04*** | (2006.01) |
| ***F28G 1/12*** | (2006.01) |
| ***F28G 15/00*** | (2006.01) |
| *F28D 7/08* | (2006.01) |

(52) U.S. Cl.

CPC ..... *B08B 9/0436* (2013.01); *F28G 1/04* (2013.01); *F28G 1/12* (2013.01); *F28G 15/003* (2013.01); *F28D 7/082* (2013.01)

(58) Field of Classification Search

CPC ..... E21B 17/00; E21B 17/10; B08B 9/0436

USPC ..... 166/241.5, 241.6

See application file for complete search history.

(56) References Cited

U.S. PATENT DOCUMENTS

| | | | | |
|---|---|---|---|---|
| 2,991,493 A | | 7/1961 | Haas | |
| 4,545,426 A | | 10/1985 | Collins | |
| 4,715,747 A | | 12/1987 | Behrens | |
| 4,827,533 A | | 5/1989 | Tanaka | |
| 5,640,780 A | | 6/1997 | Kermabon | |
| 5,941,312 A | * | 8/1999 | Vermeeren ..... | E21B 17/1071 166/241.2 |
| 6,249,927 B1 | | 6/2001 | Ando | |
| 6,332,930 B1 | | 12/2001 | Rose | |

(Continued)

FOREIGN PATENT DOCUMENTS

WO 2001/0076780 10/2001

OTHER PUBLICATIONS

Articulated Pigs by Propipe Limited article http://propipe.co.uk/sites/default/files/resources/Propipe%20Articulated%20Pig%20Data.pdf.

(Continued)

*Primary Examiner* — Michael D Jennings

(74) *Attorney, Agent, or Firm* — Boyle Fredrickson S.C.

(57) ABSTRACT

A cleaning apparatus includes a cable with spacers along the length of the cable for insertion into a tube with bends. Each of the spacers have a sphere-like body and have a diameter that is approximately the same as an inner diameter of the tube. Each neighboring pair of spacers are spaced apart from each other at approximately the same distance as the inner diameter of the tube. The cleaning apparatus is suited for passing through tubing within cracking furnaces and heat exchangers, which typically have many U-bends.

11 Claims, 25 Drawing Sheets

(56) References Cited

U.S. PATENT DOCUMENTS

| | | | | |
|---|---|---|---|---|
| 8,491,722 | B2 | 7/2013 | Phipps | |
| 8,919,436 | B2 * | 12/2014 | Wheater | E21B 17/206 166/241.5 |
| 9,234,394 | B2 * | 1/2016 | Wheater | E21B 17/10 |
| 2009/0113645 | A1 | 5/2009 | Kurbis | |
| 2010/0017980 | A1 | 1/2010 | Filippovitch | |
| 2012/0031609 | A1 | 2/2012 | Wheater | |

OTHER PUBLICATIONS

EBW-F Articulated Pig by Pipeline Cleaners Inc. article. http://www.plcpigs.com/interlocking_brush.html.

* cited by examiner

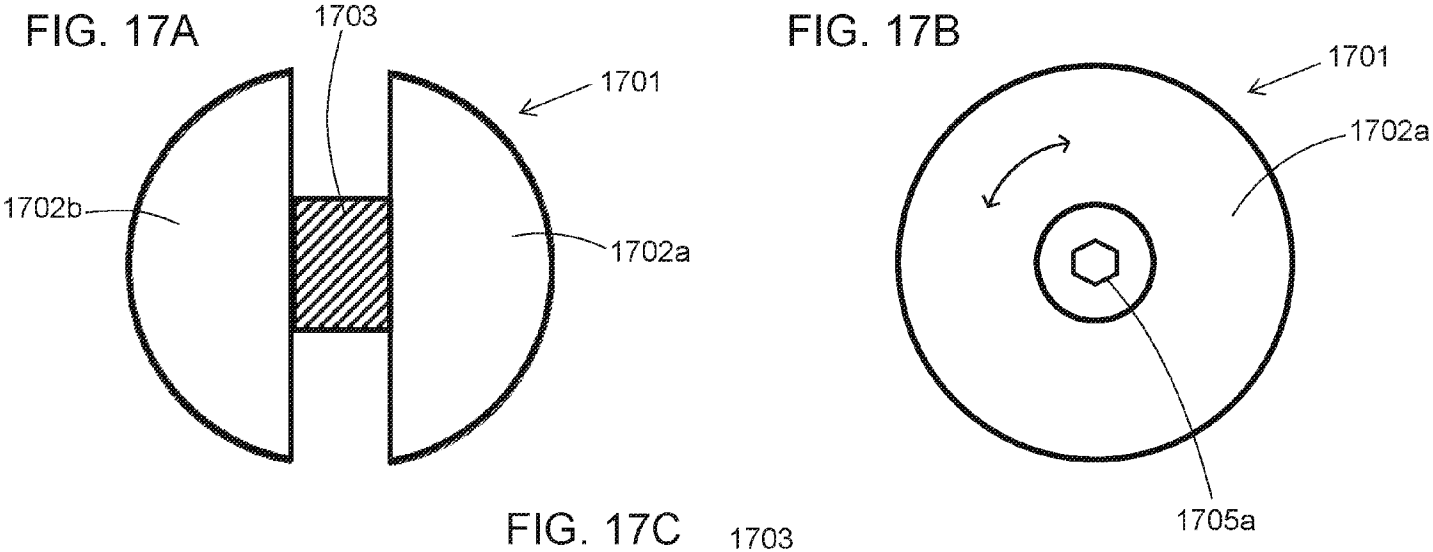
FIG. 17A
FIG. 17B
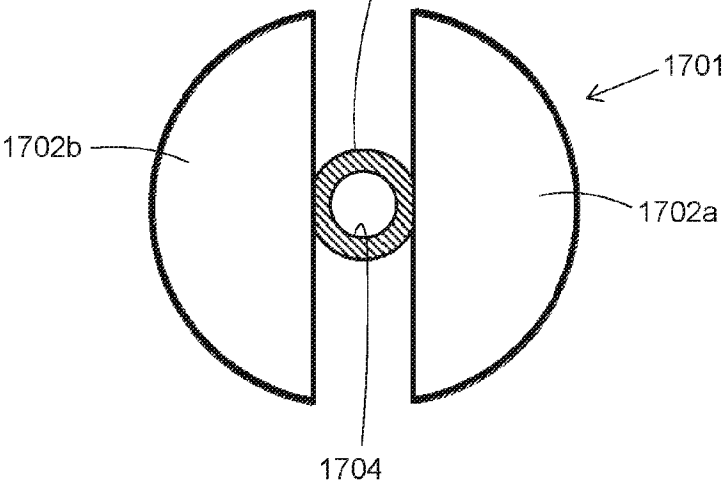
FIG. 17C

APPARATUS, SYSTEM AND METHOD FOR CLEANING INNER SURFACES OF TUBING WITH BENDS

CROSS-REFERENCE TO RELATED APPLICATIONS

This present application claims priority from U.S. Provisional Patent Application No. 62/170,842 filed on Jun. 4, 2015 and titled "Apparatus, System and Method for Cleaning Inner Surfaces of Tubing With Bends", and from U.S. Provisional Patent Application No. 62/291,112 filed on Feb. 4, 2016 and titled "Apparatus, System and Method for Cleaning Inner Surfaces of Tubing With Bends", the entire contents of which are hereby incorporated by reference.

TECHNICAL FIELD

The following generally relates to cleaning inner surfaces of tubing with bends, especially bends, like U-bends.

BACKGROUND

In the field of heater exchangers and chemical reactors, tubing is often used. For example, in cracking furnaces and heater exchangers, there are parallel tubes connected to each other at their ends using bends, such as U-bends or other types of bends, to form a continuous tube. Fluid typically flows through the piping while the chamber or environment around the piping is heated to heat the fluid flowing within the piping.

In a tubular reactor for cracking, a furnace houses banks of tubes that are connected to each other to form one or more continuous tubes for fluid to flow through. The tubes may form a serpentine configuration. Furnace guns or heat generators, for example, surround the banks of tubes.

Similarly, in a heater unit, a series of straight and parallel tubes are connected to each other using U-bends or other types of bends to make a continuous tube for fluid to flow through.

The straight parallel portions of the tubing are typically positioned close together to reduce the amount of space being used within the furnace or the heat exchanger. There may be dozens to hundreds of straight portions of tubes. The inner diameter of the tubes typically range from under one inch to several inches.

Access to the tubes is difficult and therefore cleaning the tubes is difficult. Deposits, scales, product or by-product build-up, and material in general will collect on the inner surfaces of the tubes, thereby reducing the flow of fluid within the tubes.

To clean the inner surfaces of the tubes, it is generally known that pigs are sent through the tubes under high pressure liquid. For example, pigs with scraping implements or brushes are sent through the tubing one at a time.

U.S. Pat. No. 4,545,426 describes spherical turbulators that slide along a string and are positioned within a tube of a heat exchange to induce turbulent flow. The string of turbulators stay within the tube and is not meant to be moved or pulled through the tube. The stopper beads limit the distance that the turbulators may slide along the string. The stopper beads, and therefore the turbulators, are positioned at least a factor of n times more than the diameter of the tube. It is herein recognized that it would be difficult to pull the string of turbulators through a U-bend since the string or the turbulators may catch on the U-bend surface of the tube.

U.S. Pat. No. 6,332,930 describes a large diameter pipeline cleaning arrangement with a cable pulling guide units and a pig. Only a small length of cable has guide units, and each of the guide units include three curved shoes.

U.S. Pat. No. 2,99,493 describes a pipe cleaning device for large diameter pipes, and a method that includes alternatively releasing and pulling different cables to work the device in opposite directions at any location along the pipe.

U.S. Pat. No. 4,715,747 describes an air-motivated cone that tows a mandrel through a conduit. The mandrel includes a series of plates that are spaced apart from each other. Following the mandrel is considerable length of rope or cable.

U.S. Pat. No. 4,827,533 describes an apparatus that moves a pipe cleaning device in opposite linear directions. The cleaning device includes a linear body formed from rigid tube or pipe, which would not be suitable for navigating bends.

U.S. patent application publication no. 2012/0031609 describes low friction wireline standoffs used for during borehole logging operations. The standoffs are oblong shaped and are typically positioned 10 ft to 100 ft apart from each other.

SUMMARY OF THE INVENTION

Examples embodiments of the invention are provided below, including example aspects of such embodiments. Additional features of the embodiments as well as additional example embodiments are described in the figures and the detailed description.

In an example embodiment, a cleaning apparatus includes a cable with spacers along the length of the cable for insertion into a tube with bends. Each of the spacers have a sphere-like body and have a diameter that is approximately the same as an inner diameter of the tube. Each neighboring pair of spacers are spaced apart from each other at approximately the same distance as the inner diameter of the tube. Each of the spacers has at least two surfaces set within the body to define a pair of opposite-facing frusto-conical openings through which the cable to passes.

In an example aspect of the cleaning apparatus, the inner diameter of the tube is between approximately 0.5 inches and approximately 6 inches.

In another example aspect of the cleaning apparatus, the inner diameter of the tube is approximately 1.25 inches.

In another example aspect of the cleaning apparatus, each of the spacers is made of a polyethylene material.

In another example aspect of the cleaning apparatus, each of the spacers and the tubing is made of a same material.

In another example aspect of the cleaning apparatus, the same material is a metal alloy.

In another example aspect of the cleaning apparatus, each of the spacers comprises a first material and a second material embedded within the first material, and wherein a surface of the second material is flush with a surface of the first material.

In another example aspect of the cleaning apparatus, at least one of the first material and the second material is polyethylene and the other one of the first material and the second material is a metal alloy.

In another example aspect of the cleaning apparatus, the second material forms a circumferential band around the body of each of the spacers, and the second material is the metal alloy.

In another example embodiment, a cleaning system for inner surfaces of tubing, the system includes a cable with spacers along the length of the cable for insertion into a tube with bends. Each of the spacers having a sphere-like body and each of the spacers has at least two surfaces set within the body to define a pair of opposite-facing frusto-conical openings through which the cable to passes. A cleaning apparatus is positioned on the cable amongst the spacers. The cleaning system also includes a first mover configured to pull the cable within the tubing in a first direction, and a second mover configured to pull the cable within the tubing in a second direction, opposite the first direction. The cleaning system also includes a controller device in communication with both the first mover and the second mover. The controller device includes memory that stores a database. The database includes at least a first entry that includes a first point of interest associated with a first specified location within the tubing. The controller device configured to at least: activate the first mover to pull the cable and the cleaning apparatus through the tubing; detect that the cleaning apparatus has passed the first specified location; activate the second mover to pull the cable and the cleaning apparatus backwards past the first specified location; and activate the first mover to pull the cable and the cleaning apparatus forwards past the first specified location.

In an example aspect of the cleaning system, the first point of interest is a bend in the tubing.

In another example aspect of the cleaning system, the first point of interest is a deposit build-up in the tubing.

In another example aspect of the cleaning system, each of the spacers have a diameter that is approximately the same as an inner diameter of the tubing, and each neighboring pair of spacers are spaced apart from each other at approximately the same distance as the inner diameter of the tubing.

In another example aspect of the cleaning system, the database includes a second entry that comprises a second point of interest associated with a second specified location within the tubing, and, after the cleaning apparatus has repeatedly passed over the specified location, the controller device is further configured to at least: activate the first mover to continue to pull the cable and the cleaning apparatus; detect that the cleaning apparatus has passed the second specified location; activate the second mover to pull the cable and the cleaning apparatus backwards past the second specified location; and activate the first mover to pull the cable and the cleaning apparatus forwards past the second specified location.

In another example aspect of the cleaning system, each of the spacers is made of a polyethylene material.

In another example aspect of the cleaning system, each of the spacers and the tubing is made of a same material.

In another example aspect of the cleaning system, the same material is a metal alloy.

In another example aspect of the cleaning system, each of the spacers comprises a first material and a second material embedded within the first material, and wherein a surface of the second material is flush with a surface of the first material.

In another example aspect of the cleaning system, at least one of the first material and the second material is polyethylene and the other one of the first material and the second material is a metal alloy.

In another example aspect of the cleaning system, the second material forms a circumferential band around the body of each of the spacers, and the second material is the metal alloy.

In another example embodiment, a cleaning apparatus includes a cable with spacers along the length of the cable for insertion into a tube with bends. A given one of the spacers includes two hemispheres spaced apart from each other by an interior body. The interior body includes a cable-receiving portion and a hemisphere connector. The cable-receiving portion defines therein a hole for the cable to pass therethrough. Each of the hemispheres are connected to the hemisphere connector and are rotatable about a common axis, and the given one of the spacers is rotatable about the cable.

In an example aspect of the cleaning apparatus, each of the hemispheres are independently rotatable relative to each other.

BRIEF DESCRIPTION OF THE DRAWINGS

Embodiments will now be described by way of example only with reference to the appended drawings wherein:

FIG. 17A, 17B and 17C are respectively a top view, a side view and a front view of another example embodiment of a spacer in isolation.

DETAILED DESCRIPTION OF THE DRAWINGS

Figure 1A:
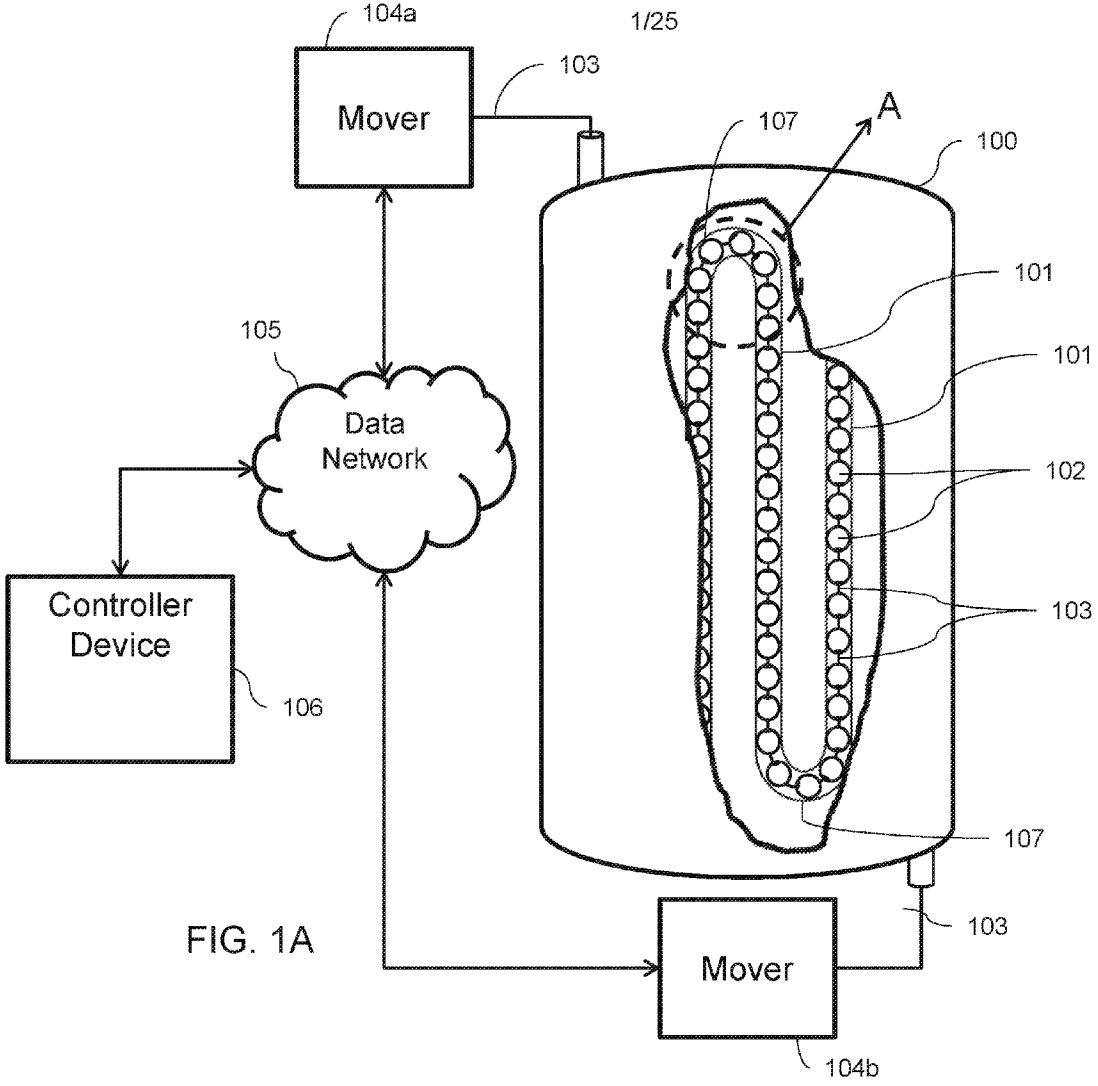
FIG. 1A is a schematic diagram of an example cleaning system for inner surfaces of tubing, showing a partial cut-away of an enclosure and a cut-away view of the tubing within the enclosure.

It will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures and components have not been described in detail so as not to obscure the example embodiments described herein. Also, the description is not to be considered as limiting the scope of the example embodiments described herein.

It is herein recognized that cleaning the inner surface of tubing in cracking furnaces and heat exchangers is difficult due to limited access, the long length of tubing, and the multiple U-bends connecting straight segments of the tubing.

Many known cleaning systems use a cable to pull a cleaning device through the tubing. However, using a cable is undesirable for cleaning a long length of tubing, because the cable may scrape the inner surface of the tubing. The scraping or rubbing of the cable will also create friction, which will increase the effort to pull the cable through the multiple U-bends in a bank of serpentine tubing.

Some of the known cleaning systems, as noted above, are more suited for large diameter pipeline applications rather than tubing. The known cleaning systems also describe cleaning devices with spacers that are not suited for navigating U-bends for tubing.

Turning to FIG. 1A, an example embodiment of an enclosure 100 is shown. A partial cut-away illustrates that the enclosure contains a number of parallel tubes 101 joined by U-bends 107 to form at least one continuous length of tubing.

The enclosure, in one example embodiment, is for a carbon cracking furnace or other type of cracking furnace. In another example embodiment, the enclosure is for a heat exchanger. It will be appreciated that the principles described herein are applicable to other structures involving tubing, especially tubing with bends.

A cable 103 passes through the entire length of the tubing. All, or substantially the entire length, of the cable includes a series of sphere-like spacers 102 that space the cable away from the inner surface of the tubing 101.

In the example shown in FIG. 1A, one end of the cable is attached to a first mover 104*a* and another end of the cable is attached to a second mover 104*b*. The movers 104*a* and 104*b* are in data communication with a controller device 106 over a data network 105. The data network 105 is a wired network according to one example embodiment. The data network 105 is a wireless network according to another example embodiment.

The movers 104*a*, 104*b*, are generally referenced by the numeral 104. In an example embodiment, a mover is configured to pull the cable 103 under mechanical power, such as by a motor.

Figure 1B:
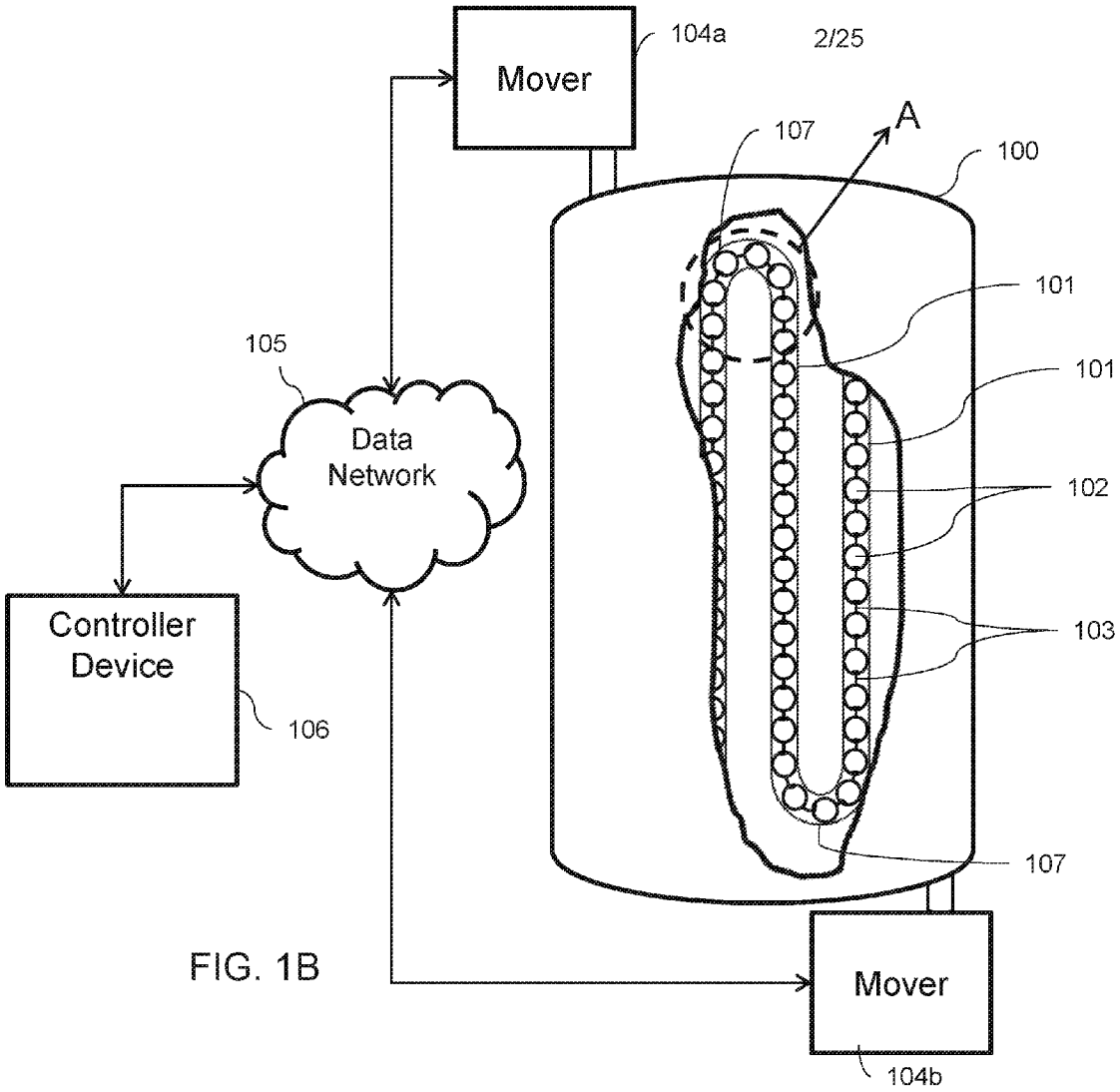
FIG. 1B is a schematic diagram similar to FIG. 1A, but with movers configured to generate positive pressure or vacuum pressure, or both, in the tubing.

In another example embodiment, as shown by FIG. 1B, the movers 104*a*, 104*b* use air or liquid pressure (e.g. positive pressure or vacuum pressure, or both) to move the spacers and the cable through the tubing. In particular, the spacers and the cable may be blown through a tube with air or liquid. In addition or in the alternative, the spacers and the cable are drawn through the tubing with a vacuum. In other words, the movers may include a liquid pump, or an air blower, or both, to generate pressure, either a positive pressure or a vacuum pressure, or both.

For example, mover 104*a* may provide positive liquid or gas pressure, and mover 104*b* may provide vacuum pressure via a liquid or a gas. These movers may work together to move the spacers and the cable through the tubing.

In another example, both movers provide vacuum pressure at different times. In another example, both movers provide positive pressure at different times.

In another example, the movers include a combination of a cable pulling system with a positive fluidic pressure system or a vacuum fluidic pressure system, or both. In other words, the spacers and the cable may be pushed or pulled (or both) through the tubing using more than one system.

Figure 2:
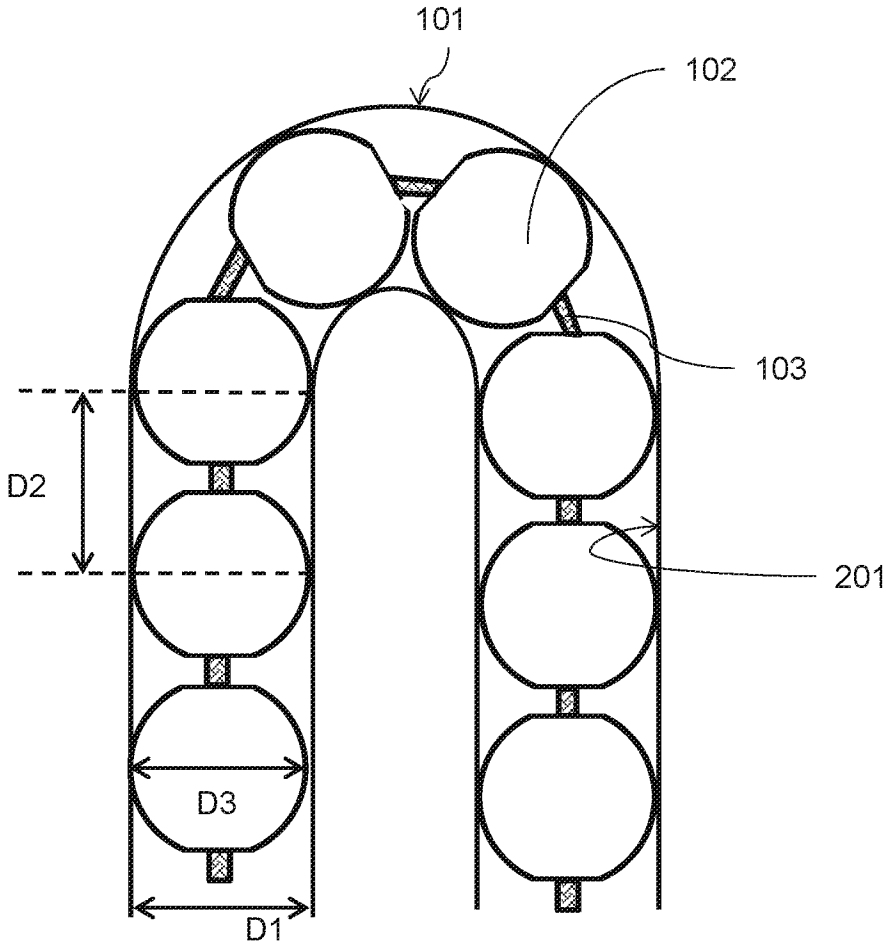
FIG. 2 is an enlarged view of a portion of the tubing shown in FIGS. 1A and 1B, labelled "A", and more clearly shows a series of spacers within the tubing.

FIG. 2 shows an enlarged segment of a U-bend labeled "A" in FIGS. 1A and 1B. The inner diameter of the tubing is D1. The distance between the centers of neighbouring spacers 102 is D2. The diameter of a spacer is D3. In a preferred example embodiment, D3 is sized to be approximately the same as D1. D2 is also sized to be approximately the same as D1. This sizing and spacing helps to space the cable 103 away from the inner surface 201, even at the U-bend. Furthermore, this sizing and spacing helps to facilitate cleaning as each spacer 102 rubs against a larger portion of the inner circumference surface 201 of the tubing.

It will be appreciated that the U-bend shown here has a 180 degree bend. The radius of the bend, for example, is approximately half of D1. Such tight U-bends are typical in furnaces and heat exchangers in order to conserve space. Other shapes of bends to connect straight segments of tubing are applicable to the principles described herein.

In an example embodiment, D1 is approximately 1.25 inches. D3 is approximately 1.25 inches, and may be a little less. For example, D3 is approximately 1.23 inches. The distance D2 is approximately 1.25 inches as well.

In another example, D1 is between approximately 0.5 inches and approximately 6 inches.

It will be appreciated that other relative sizes and spacing may be used to space the cable away from the inner surface of the tubing. It will also be appreciated that other sizes of spheres and tubing are applicable to the principles described herein.

Figure 3:
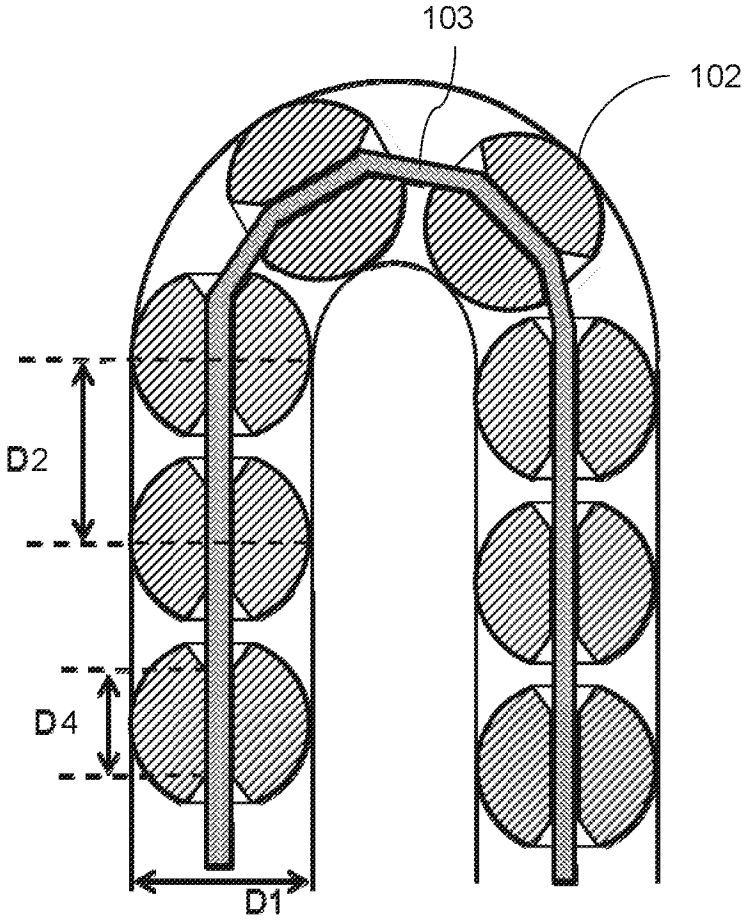
FIG. 3 is a cross-sectional view of the spacers, as shown in FIGS. 1A and 1B, and more clearly shows the cable passing through the spacers.
Figure 4:
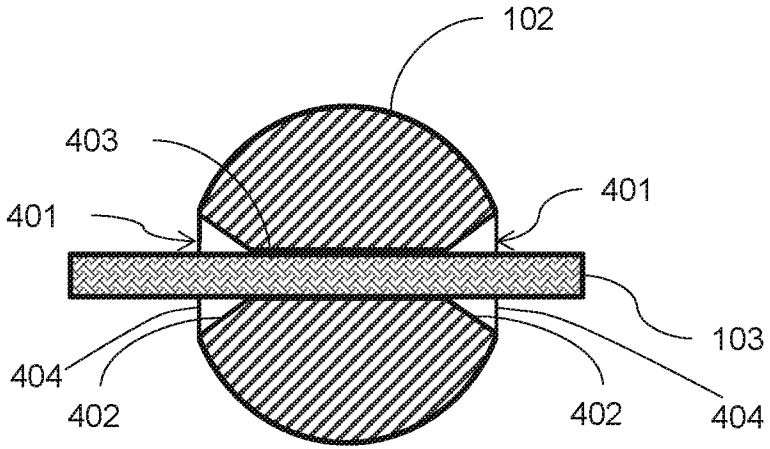
FIG. 4 is an isolated view of a single spacer, showing a cross-section of the single spacer.

FIG. 3 shows a cross-sectional view of the spacers 102 according to the diagram shown in FIG. 2. FIG. 4 shows a cross-sectional view of an isolated spacer 102 with a cable 103 passed through.

As per FIGS. 3 and 4, openings or voids 401 on opposite ends of the spacer 102 are formed by at least two substantially frusto-conical surfaces 402. Due to the openings 401, the side profile of each spacer 102 therefore shows a flat profile line 404, which interrupts the rounded profile of each spacer. An inner surface 403 defines a channel for connecting the space between the openings 401. The spacer is fixed to the cable along at least part of the surface 403. For example, the spacer is fixed to the cable using a clamp. Other mechanisms may be used to secure the spacer to the cable.

The length of the inner surface 403 defining the channel is denoted by D4. In an example embodiment where D1 is approximately 1.25 inches, and where D2 and D3 are approximately 1.25 inches, D4 is approximately ⅞ of an inch. It will be appreciated that other dimensions of D4 are applicable to the principles described herein.

The frusto-conical openings 401 allow the cable 103 to bend more gradually, especially around U-bends. This is best shown in FIG. 3. The frusto-conical openings are also helpful to allow room for the cable 103 to bend or flex, without pinching the cable, especially in embodiments in which the spacers 102 are closely positioned together.

As will also be appreciated from FIG. 3, the sphere-like shape of the spacers 102 is suited for moving through U-bends. By contrast, more oblong shaped structures would get stuck in a U-bend since there is little space to maneuver.

More generally, the sphere-like shape of the spacers and the series of spacers along the cable help the cable to pass through tights bends in the tubing. The configuration described herein also allows the cable and the spacers to conform uniformly with the path of the tubing. The configuration also reduces the amount of twisting of the cable as it is pulled through the tubing, which may have multiple bends and have different orientations of the bends. The configuration further helps to provide a more equal distribution of tension along the length of the cable.

In an example embodiment, the spacers 102 are made of a plastic material. A non-limiting example of a plastic is polyethylene. It may be desirable to make the spacer from polyethylene because the cracked ethylene is a product of the cracking process. In this way, the spacers do not introduce any materials that are different than the cracking process, and thus do not contaminate the cracking process.

In another example embodiment, the spacers 102 are made of the same material as the tubing. For example, if the tubing is made of metal or chrome material, then the spacers are made from the same material. In this way, there is reduced risk that similar materials will scrape against to cause debris and, if there is debris, the material from the tubing or the spacers is the same material.

It will be appreciated however, that other types of materials may be used to form the spacers. Non-limiting examples of materials include plastic compounds, ceramics, coated ceramics, metals, and coated metals.

Figure 14A:
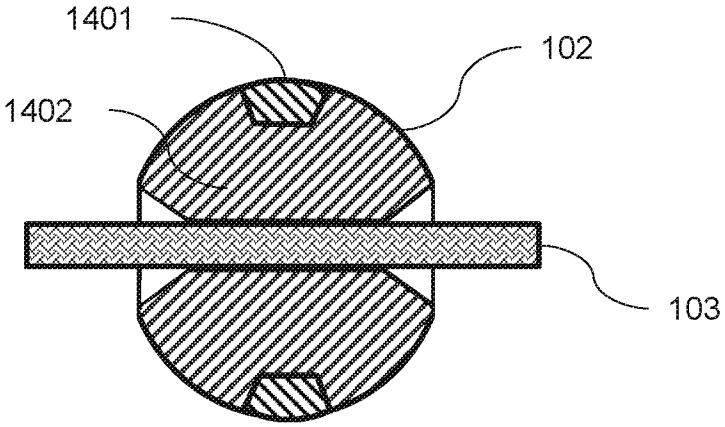
FIG. 14A is a cross-sectional view of an example embodiment of a spacer shown in isolation, the spacer including two different materials.
Figure 14B:
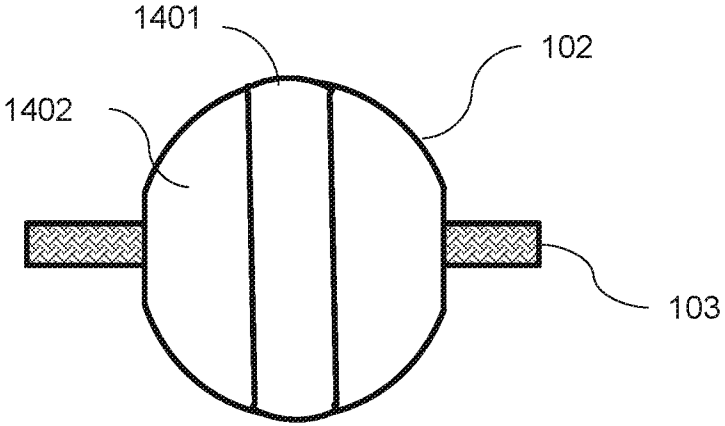
FIG. 14B is a side view of an the spacer shown in FIG. 14A showing the two different materials.

Turning to FIG. 14A and FIG. 14B, an example embodiment of a spacer 102 is shown in isolation formed from two different materials. In an example embodiment, the main body 1402 of the spacer is formed from a polyethylene plastic, and a circumferential band or ring 1401 is made of an alloy that is the same material as the tubing. For example, the alloy includes a 5% chrome composition. The metal or alloy band 1401 goes around the circumference of the spacer and is configured to rub or scrape against the inner surface of the tube 201 to remove scaling and deposits. The second material is preferably flush with the first material to form a seemingly continuous surface of the body of the spacer. In other words, the outer surface of the second material and the first material are flush with each other. In this way, spacer may slide through the tubing, including through U-bends, with little or no snagging. As shown in the cross-sectional view in FIG. 14A, the depth of the second material 1401 is relatively shallow. This configuration, for example, saves on material costs.

In another example embodiment, the second material 1401 is not continuous positioned around the entire circumference. For example, the second material is embedded within the first material as dots or other shapes.

In another example embodiment, not shown, the cable and the spacers are integrally formed together. For example, the cable and the spacer are manufactured as one piece.

In another example embodiment, the assembly of the cable and the spacers are formed from separate components, and is thereafter coated with a coating. For example, the assembly is coated in a plastic compound or a lubricant. Examples of plastic compounds include polyethylene and polyvinyl chloride. In another example, the coating may be cured or hardened, such that the overall appearance of the assembly will be that the cable and the spacers are integrally formed as one piece. In yet another example, one or more portions of the assembly of the cable and the spacers are coated.

Figure 5:
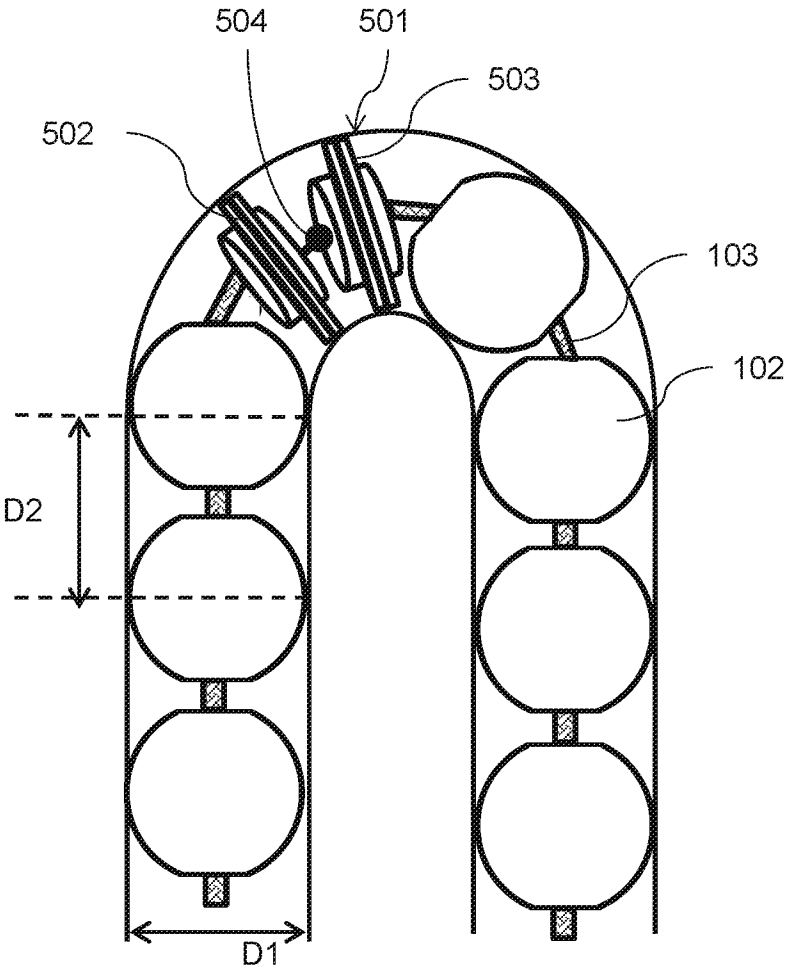
FIG. 5 is another example of a cleaning line positioned within a tube, the cleaning line including a series of spacers and a cleaning apparatus.

Turning to FIG. 5, another example embodiment of a cleaning apparatus is shown. Along the length of the cable 103, there may be one or more cleaning pigs 501. In the segment of the cable shown in FIG. 5, there is one cleaning pig 501 amongst the series of spacers 102.

The cleaning pig 501 is, for example, an articulated pig with a first segment 502, a second segment 503, and an articulating linkage 504 between the first and the second segments 502 and 503. Other types of pigs may be used with series of spacers on the cable. For example, the pig does not need to be articulating.

Figure 6:
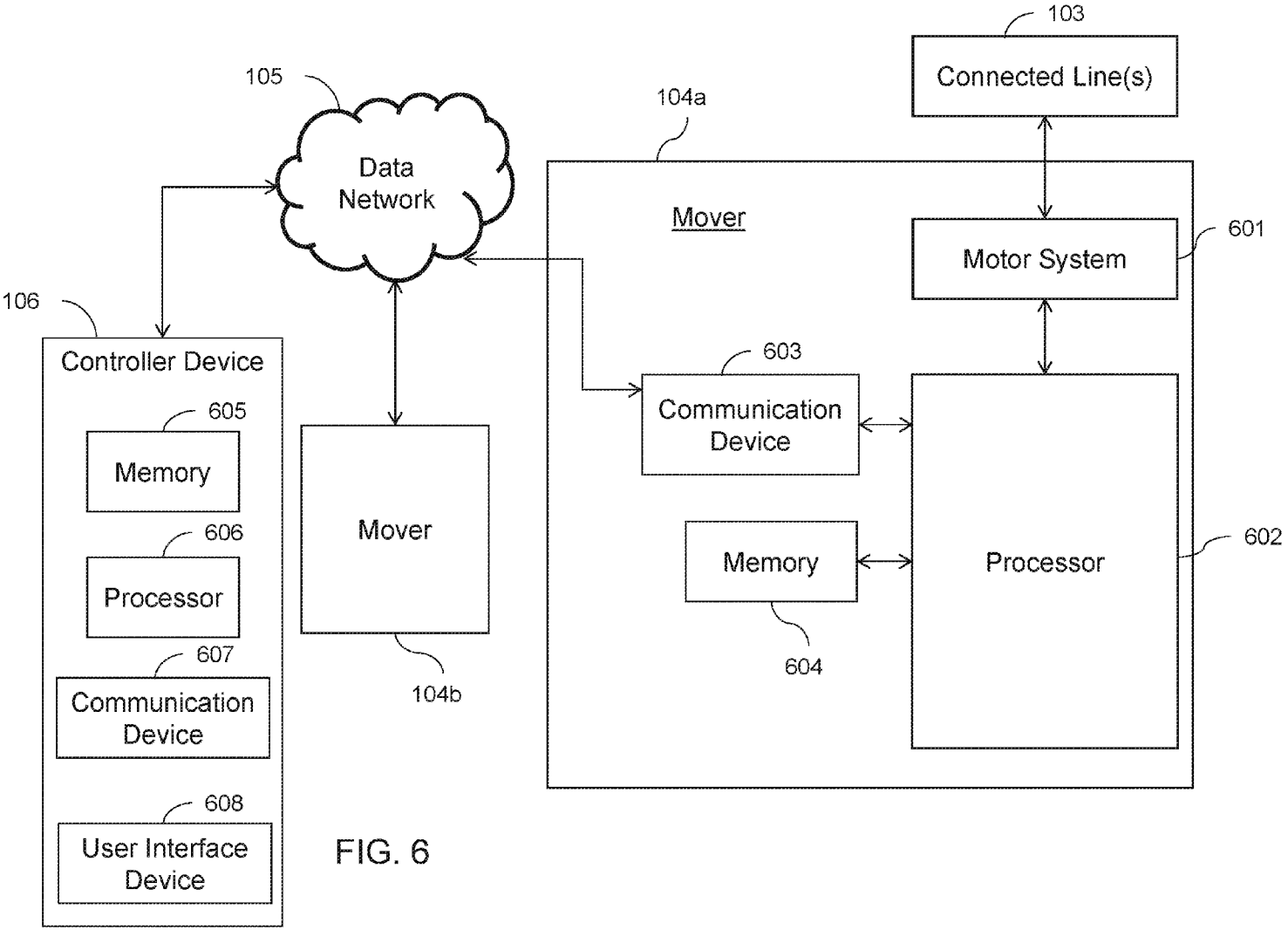
FIG. 6 is a block diagram showing example components of a cleaning system.

Turning to FIG. 6, a block diagram of an example embodiment of the cleaning system is shown. It includes a first and a second mover 104*a*, 104*b*, and a controller device 106.

The movers 104*a*, 104*b* are similar to each other. Example components of a mover are therefore applicable to both movers 104*a*, 104*b*. A mover includes a motor system 601 that is connected to the cable 103. The motor system is controlled by a processor 602. The processor 602 is in data communication with a communication device 603 and memory 604. The communication device 603 is used to communicate with the data network 105. The motor system 601 is configured to wind and unwind a length of the cable 103.

The controller device 106 includes memory 605, a processor 606 and a communication device 607. The controller device may also include one or more user interface devices 608, such as a display screen and input keys. The controller device sends control commands, via the data network, to one or both movers.

In an example embodiment, the controller device coordinates the operation of both movers.

It will be appreciated that the memory 604, 606 are configured to store processor implemented instructions and data.

Figure 7:
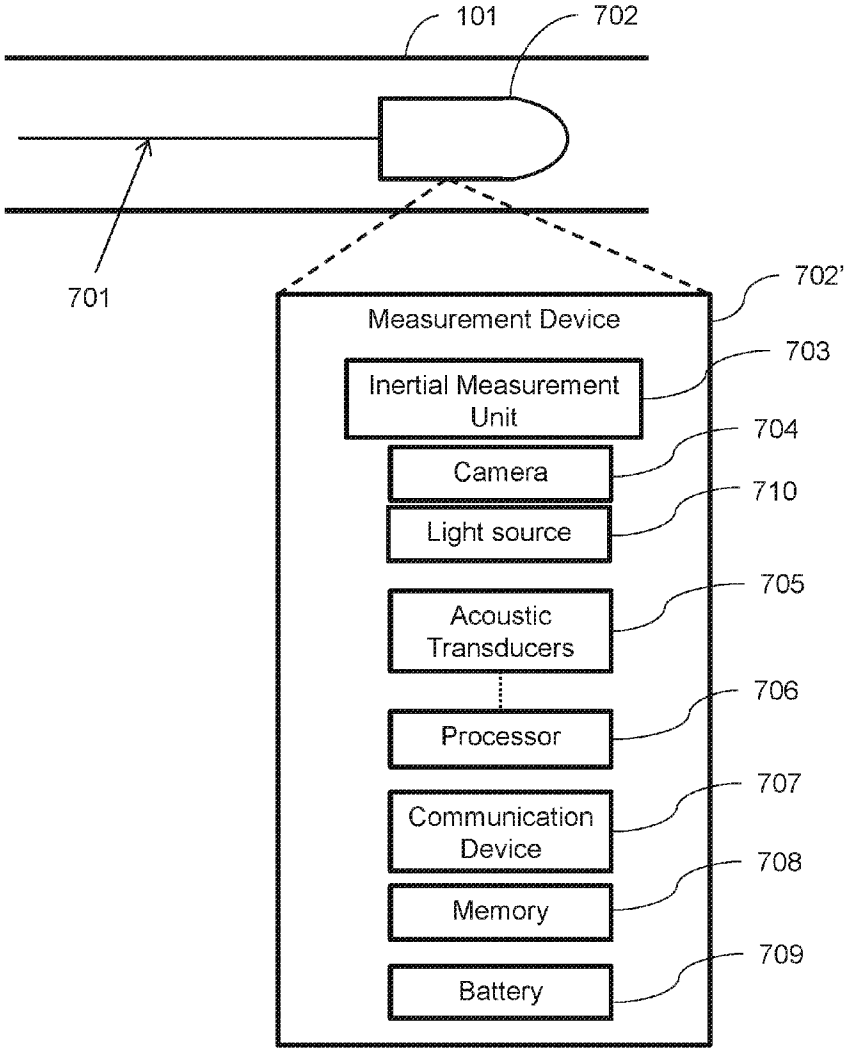
FIG. 7 is a schematic diagram showing a measurement device within a segment of tubing, which may be used with the cleaning system, and further showing example components of the measurement device.

Turning to FIG. 7, a schematic diagram of an example measurement device 702 is shown in a segment of tubing 101. In an example embodiment, the measurement device 702 is sent through the tubing 101 before sending the cable 103 with the spacers 102.

The measurement device is used to measure information including, for example, the location of a bend in the tubing and the location of deposit or debris build-up. This measured information is used to assist with cleaning the tubing.

In an example embodiment, the measurement device is sent through the tubing using pressurized fluid (e.g. gas or liquid) and is trailed by a scout line 701, which is a thinner cable or line compared to the cable 103. This scout line is passed through the length of the tubing, and one end of the scout line is attached to one end of the cable 103. In this way, the scout line is able to pull the cable 103 through the length of tubing. This process is sometimes referred to as "fishing".

In another example embodiment, the fishing process may include the scout line, a second or intermediary line and the cleaning line. Further details are described below.

Example components of the measurement device are shown in block 702'. An inertial measurement unit 703, such as a multi-axis accelerometer or a gyroscope, or both, is used to detect the change of direction when the measurement device moves through the tubing. For example, changes of acceleration in different directions or changes in orientation, or both, are used to indicate that there is a bend in the tubing.

A camera 704 may be used to gather visual data about debris or deposits within the tubing. A light source 710 on the measurement device may also be included to illuminate the environment within the tubing.

An acoustic transducer 705, such as an ultrasonic transducer, may also be used to detect scaling, debris and deposits along the length of the tubing. Currently known and future known ultrasonic transducer configurations for detecting scaling or deposits, as well as currently known and future known data processing techniques related to processing the ultrasonic transducer data may be used according to the principles described herein.

Other sensors, other than those shown in FIG. 7, or different combination of sensors, may be used in the measurement device.

The measurement device also includes a processor 706, a communication device 707, memory 708 and a battery 709.

While the measurement device is moving in the tubing, its position within the tubing is measured. In an example embodiment, its position or location is measured based on the length of the scout line 701. For example, when the length of the scout line from an opening entrance of tubing to the measurement device is X meters, the position or location of the measurement device is X meters.

The length of the scout line may be measured in a number of ways. In an example embodiment, a device that unravels or unwinds the scout line is able to measure the length of the scout line being unravelled. The length of the scout line, and therefore the location of the measurement device, is recorded and marked with time stamps.

The data measured by the measurement device may be stored in a database for retrieval later on, and may be marked with a time stamp. The time stamp is common to both the location and the data from the measurement device. Therefore, the time stamp is used to correlate the measured data with the position of the measurement device within the tubing. In this way, the location of bends and deposit areas may be identified.

In another example embodiment, the data being measured by the measurement device is being transmitted using the communication device 707 to the controller device 106 via the data network 105. The data regarding the bends or deposits are stored in a database in relation to the location of the measurement device, at which such data was collected.

Figure 8:
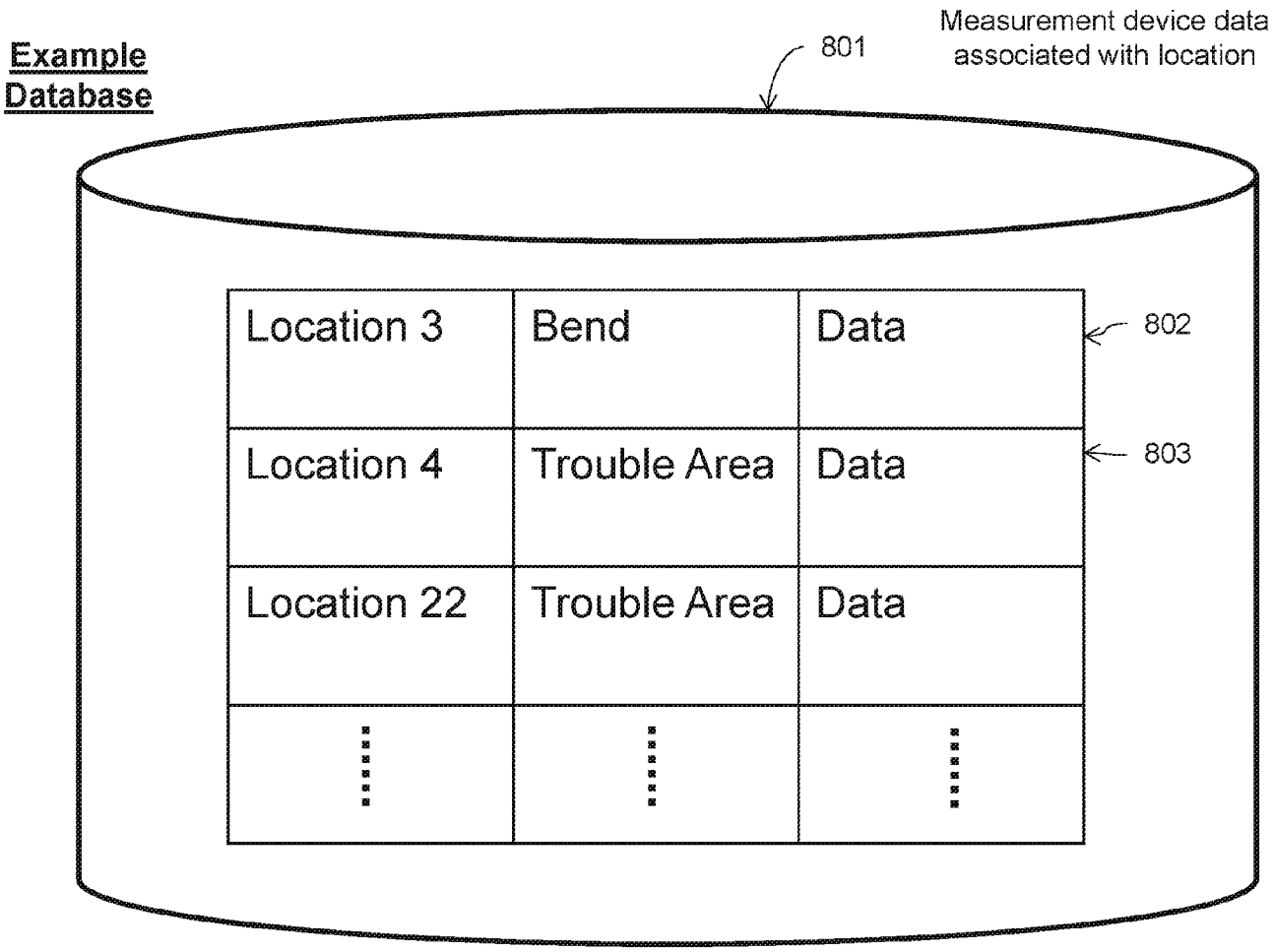
FIG. 8 is a database showing example data of measurement device data stored in association with location data.

An example database 801 is shown in FIG. 8. For example, one entry 802 specifies a location, that there is a bend at the location, and other associated data. The other associated data may be the raw data measured by the measurement device at the specified location. The other associated data may also include derived data from the raw measured data, such as the degree of the bend or the shape of the bend.

Another example entry 803 in the database specifies a different location, there is a trouble area at the specified location, and other associated data. For example, the other associated data includes images of the troubled area, and the extent of the debris or deposits.

The database 801 may reside in memory on the controller device 106, or in memory on the movers 104, or in memory on all the devices.

Figure 9:
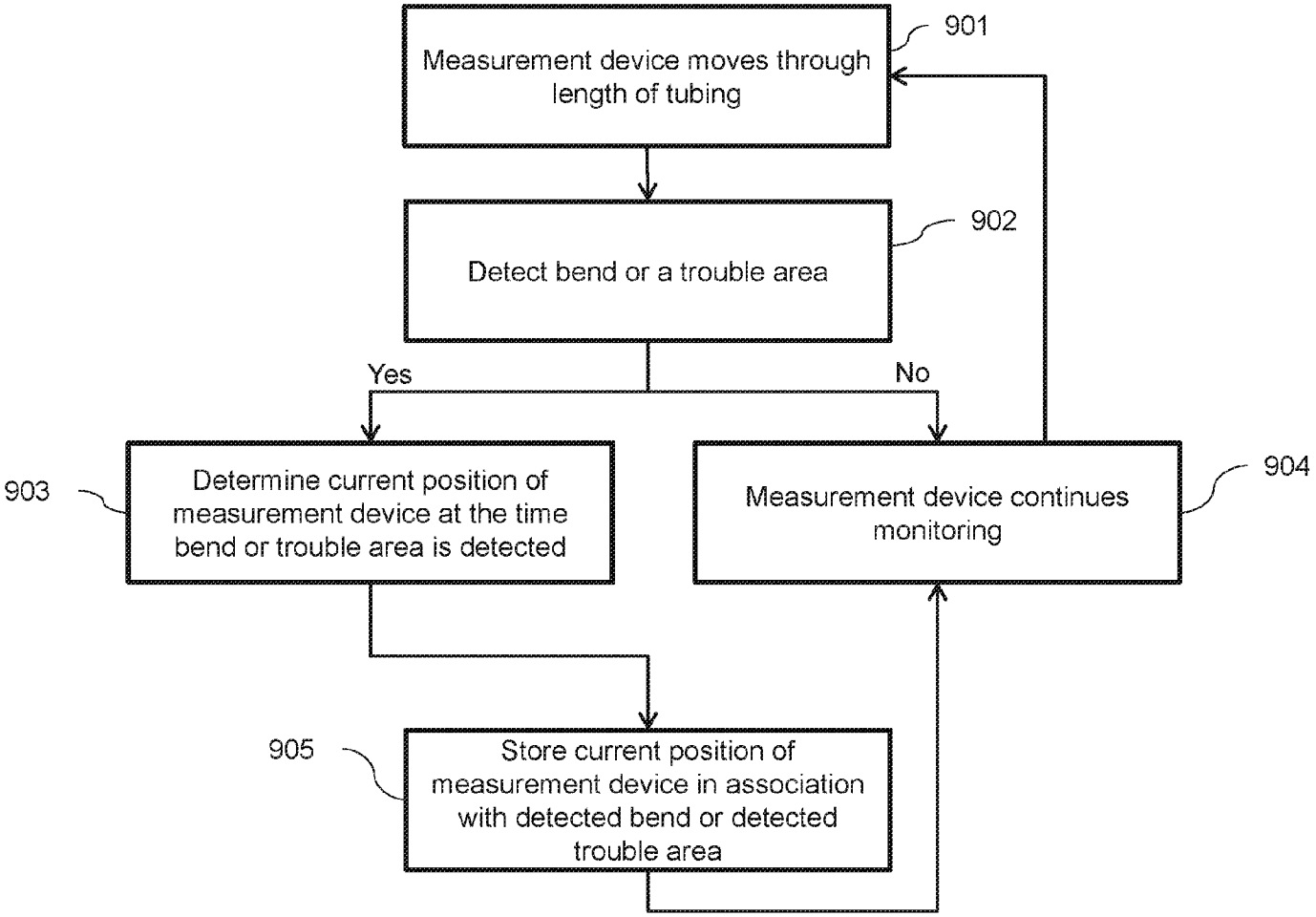
FIG. 9 is a flow diagram of example processor implemented instructions for detecting a bend or a trouble area, and storing this information in associating with a location within the tubing.

Turning to FIG. 9, example executable instructions are provided for gathering and storing data from the measurement device.

At block 901, the measurement device is activated as it moves through a length of tubing. At block 902, using the sensors on the measurement device, the measurement device determines if it detects a bend or a trouble area. If not, the process continues to block 904 and the measurement device continues to monitor the measure data. From block 904, the process loops back to block 902.

If a bend or a trouble area is detected, the process continues to block 903. Another device, such as a controller device, which is communication with the measurement device, determines the current position of the measurement device at the time the bend or trouble area is detected. At block 905, the other device then stores the current position of the measurement device in association with the detected bend or the detected trouble area. The process continues to block 904 as the measurement device continues monitoring.

It will be appreciated that the process shown in FIG. 9 occurs while the measurement device is moving within the tubing. In another example, the computing and correlation of the measured data and the location occurs after the measurement device has passed through the entire tubing and is recovered at an exit opening.

Figure 10:
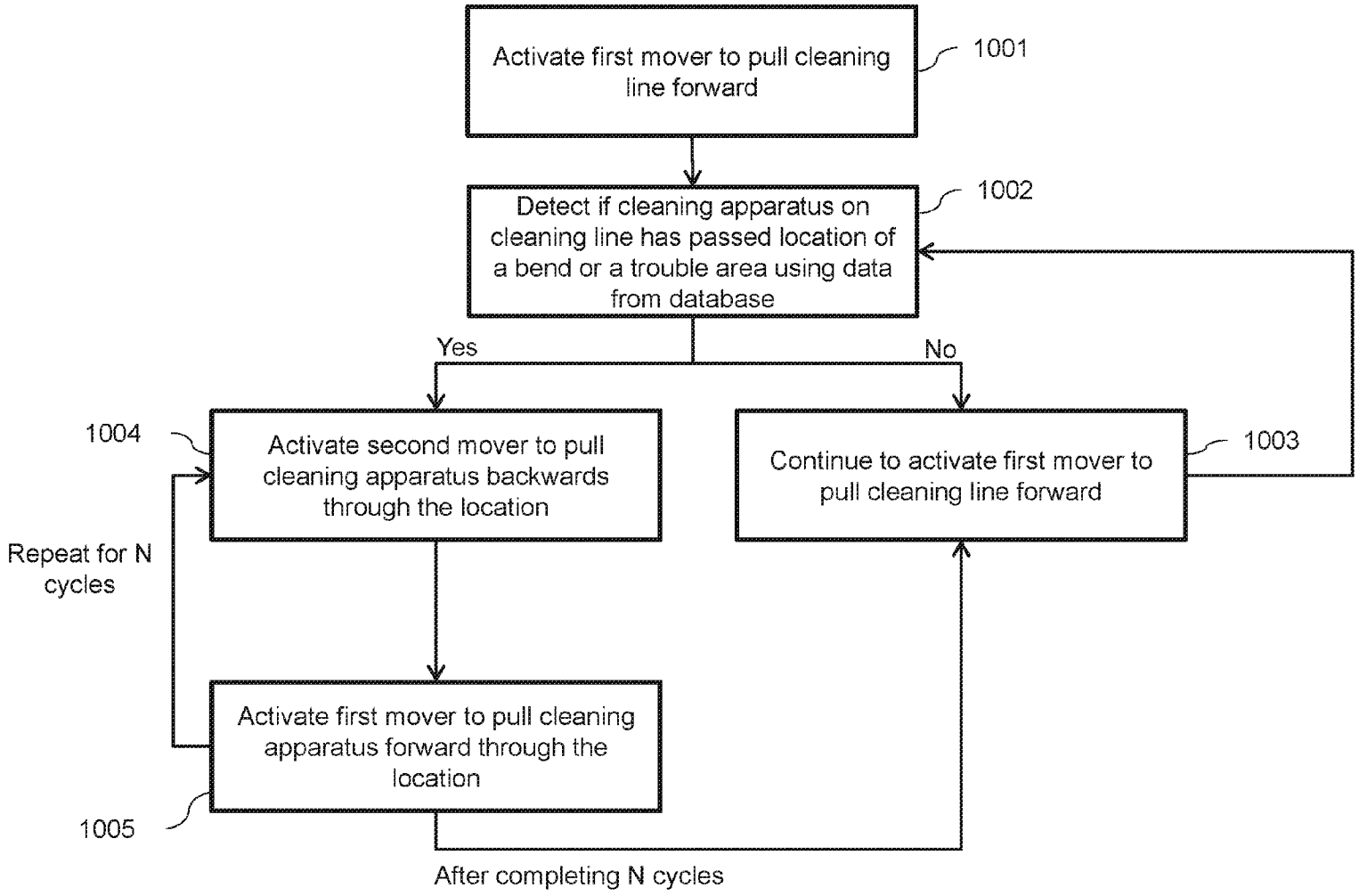
FIG. 10 is a flow diagram of example processor implemented instructions for operating the cleaning system to clean a specific location within the tubing.

Turning to FIG. 10, example executable instructions are provided for a cleaning process using the example system shown in FIG. 1. In this example, one or more cleaning apparatuses, such as a pig, are included on the cleaning line. See, for example, FIG. 5. At block 1001, a first mover is activated to pull the cleaning line 103 forward through the tubing.

At block 1002, the controller device or the first mover, or both, determine whether or not the cleaning apparatus on the cleaning line has passed a location of a bend or a trouble area. This determination is made based on the database 801, which includes locations of bends and trouble areas.

If not, the process continues to block 1003 and the controller device continues to activate the first mover to pull the cleaning line forward. From block 1003, the process loops back to block 1002.

If the cleaning apparatus has passed a location of a bend or a trouble area, as per the database, then the process continues to block 1004. The controller device activates a second mover to pull the cleaning apparatus backwards through tubing, past the specified location. Correspondingly, the controller device instructs the first mover to unwind or allow unwinding of the cleaning line. At block 1005, the controller device activates the first mover to pull the cleaning apparatus forward through the tubing, past the specified location. Correspondingly, the controller device instructs the second mover to unwind or allow unwinding of the cleaning line.

Blocks 1004 and 1005 are repeated for N cycles, where N is an integer. In this way, the cleaning apparatus is moved back and forth over a bend or a trouble area to better clean that location.

It is desirable to move a cleaning apparatus over a bend since scaling, deposits, and build-up of debris typically occurs at a bend in the tubing.

After completing the N cycles, the process continues to block 1003, in which the controller device activates the first mover to continue pulling the cleaning line forward. From block 1003, the process loops to block 1002.

In an example embodiment, the value of N is a dynamic number rather than a constant. The value of N may be computed based on the data measured from the measurement device. For example, if there is more scaling or deposits detected at a certain location, then the value of N may be higher to provide more cleaning action for that certain location. A location with less measured deposits or scaling will have a value of N that is lower. This will improve the efficiency and effectiveness of the cleaning system.

Figure 11:
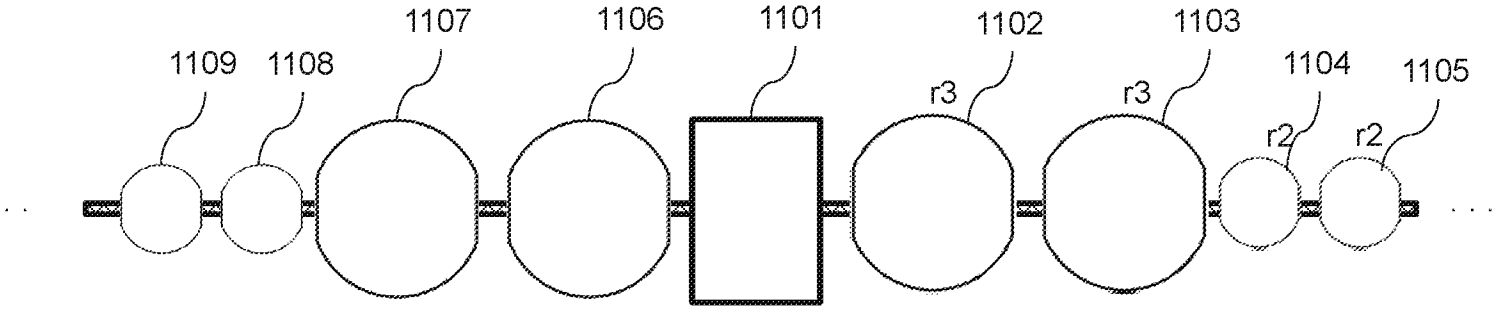
FIG. 11 is a side view of an example embodiment of a cleaning line, including a cleaning apparatus and different sized spacers.

Turning to FIG. 11, another example embodiment of a cleaning line is shown. A segment of the cleaning line is shown, which shows the cable 103 having affixed to it a cleaning apparatus 1101. To one side of the cleaning apparatus, spacers 1102 and 1103 are positioned, which are sized to be similar to the cleaning apparatus 1101. The radius of spacers 1102 and 1103 is denoted by r3. Positioned further away from the cleaning apparatus 1101 along the length of the cable are spacers 1104 and 1105 with a smaller radius r2. In other words, r2<r3. The majority of the length of the cable has attached the spacers with the radius r2.

To the opposite side of the cleaning apparatus, spacers 1106 and 1107 are positioned, which have the same size as spacers 1102 and 1103. Extending outwards in the same direction for the majority of the length of the cable are the smaller sized spacers 1109, 1108 having the radius r2.

Figure 12:
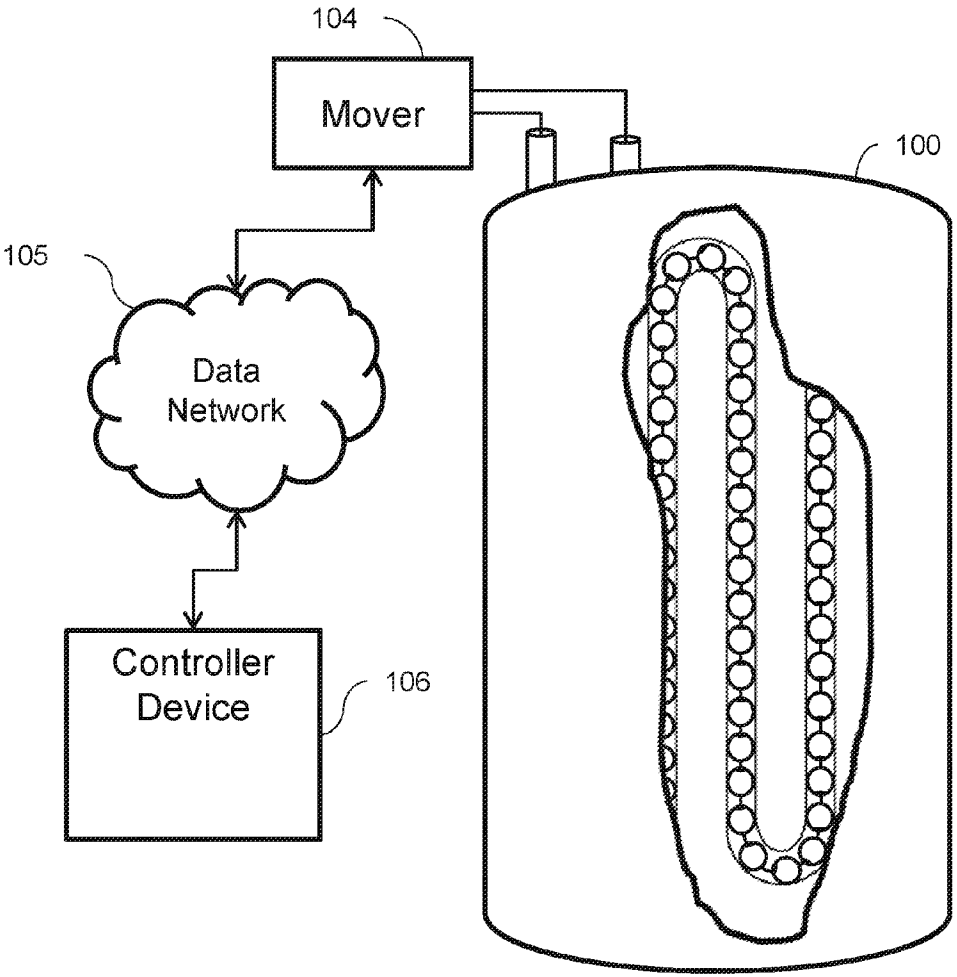
FIG. 12 is a schematic diagram of another example of a cleaning system using a single mover for the cable.

Turning to FIG. 12, an alternative example embodiment of a tube cleaning system is shown. A single mover 104 is used to move the cable 103 in both directions. This may be implemented by using pulleys, although not required. This may embodiment may be desirable when the entrance and exit of the cable 103 are positioned closer together.

Figure 13:
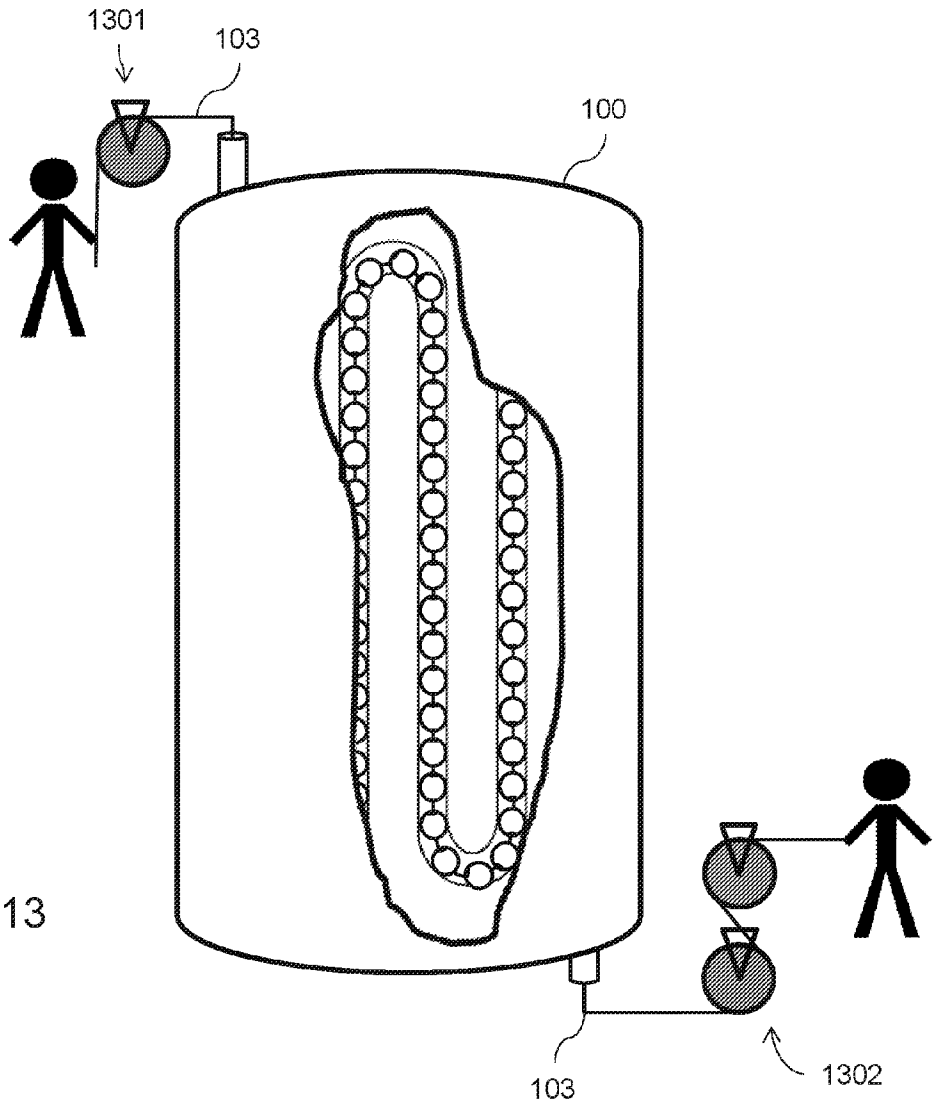
FIG. 13 is a schematic diagram of another example of a cleaning system using devices to manually pull the cable.

Turning to FIG. 13, another example embodiment of a tube cleaning system is shown. The cable 103 with the spacers is manually pulled through the tubing using pulley devices 1301 and 1302.

Figure 15A:
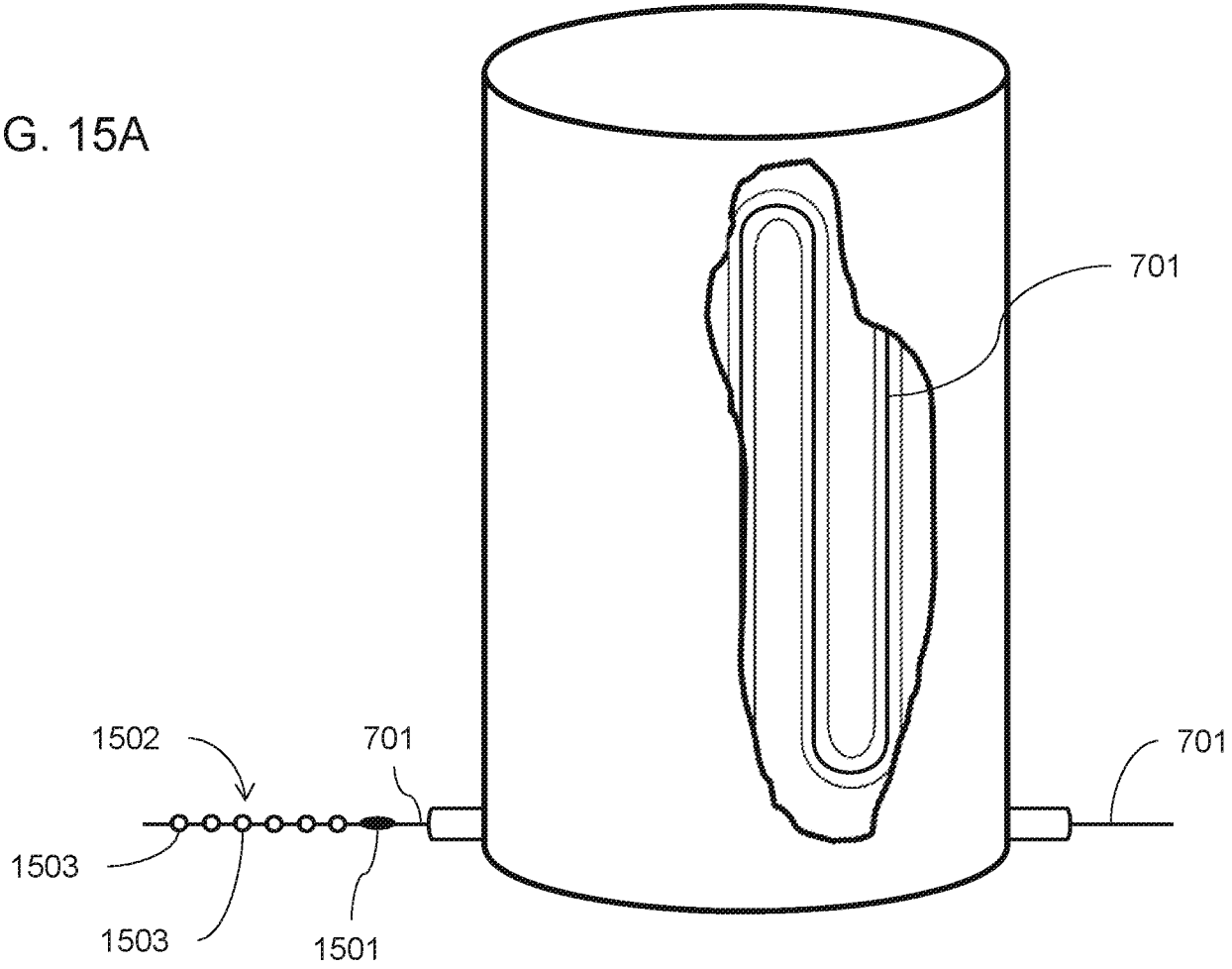
FIGS. 15A, 15B and 15C are schematic diagrams showing different stages of pulling first a scout line, secondly an intermediary line, and subsequently a cleaning line.
Figure 15B:
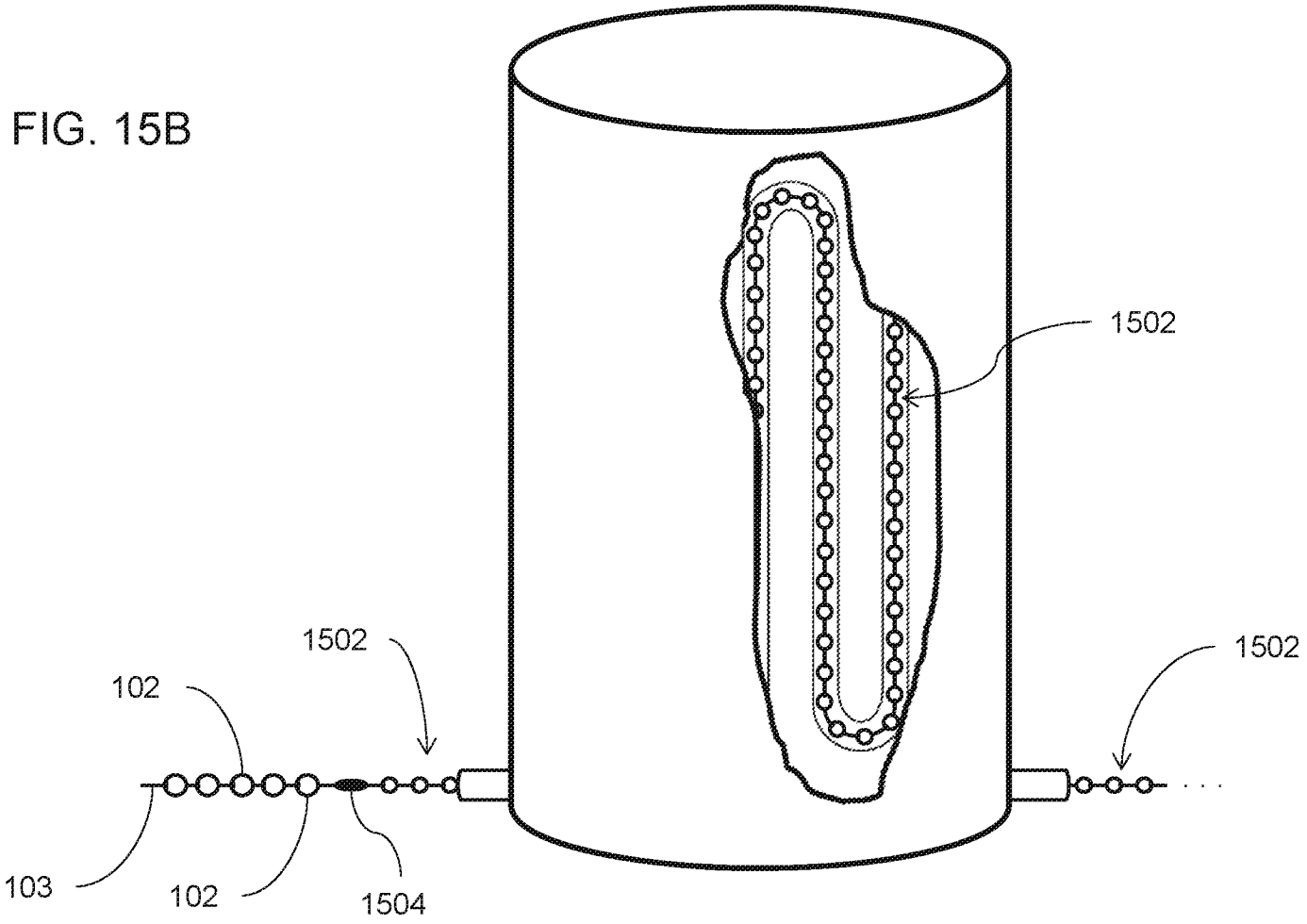
Figure 15C:
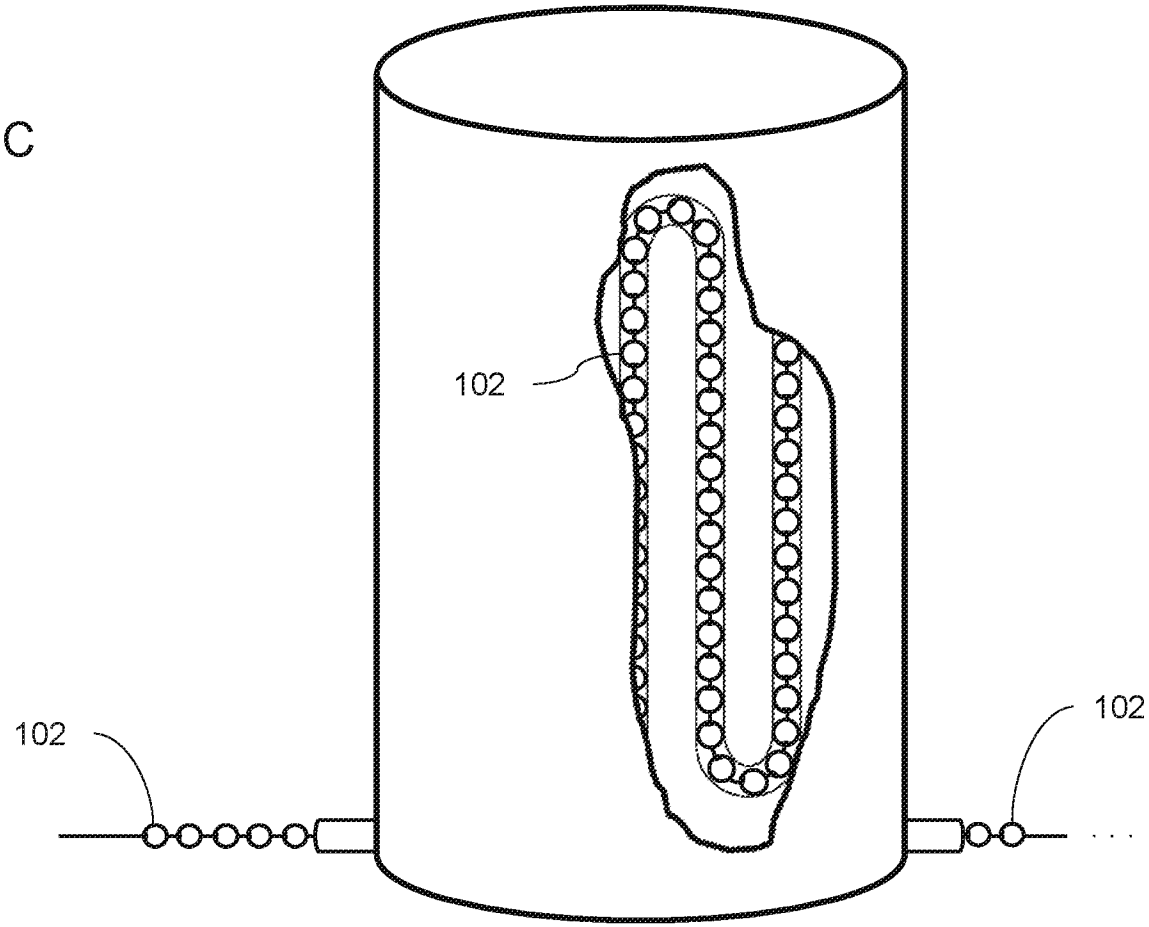

Turning to FIGS. 15A, 15B and 15C, an example embodiment of fishing is provided, including the scout line 701, a second or intermediary line and the cleaning line. In FIG. 15A, the scout line is first sent through the tubing. One end of the scout line is then attached to an intermediary line 1502 using a transition piece 1501. The scout line is used to pull the intermediary line through the tubing, as shown in FIG. 15B.

The scout line is preferably a light line, which will be easy to pull through the tubing.

The intermediary line 1502 includes a similar configuration of the spacers and the cable as described above. However, in the intermediary line, the spacers 1503 are relatively smaller and thus, the intermediary line will be easier to pull through the tubing. Furthermore, the cable of the intermediary line may be also of a smaller gauge or thickness compared to the main cleaning cable 103.

For example, in an application in which the diameter D1 of the tubing is approximately 2 inches, and the approximate diameter D3 of the spheres 102 of the cleaning apparatus is approximately 2 inches, then the diameter of the spheres on the intermediary line is approximately 1 inch. In other words, in a general example embodiment, the diameter of a sphere on the intermediary line is approximately half of the inner diameter of the tubing. It will be appreciated that other relative dimensions between the diameter of a sphere on the intermediary line and the inner diameter of tubing are applicable to the principles described herein.

In FIG. 15B, after the intermediary line has passed through the tubing, one end of the intermediary line is attached to the cleaning line, or cable 103, using a transition piece 1504. The intermediary line is then used to pull the cleaning line through the tubing, as shown in FIG. 15C.

Using an intermediary line is desirable when the scout line is not strong enough to pull the cleaning line. It is also recognized that, in some cases, attaching the scout line directly to the cleaning line may cause the scout line to also stick to the bends. Therefore, an intermediary line may help to act as a transition between the scout line and the cleaning line.

Figure 16A:
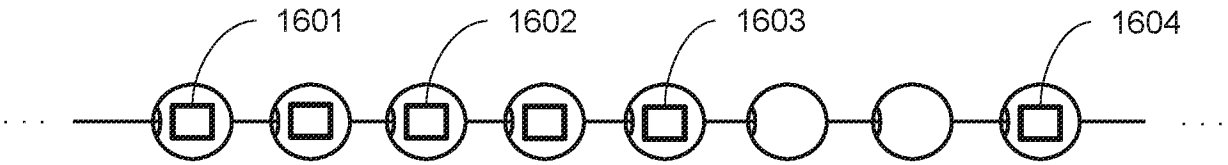
FIG. 16A is a schematic diagram of components within the series of spacers according to an example embodiment.

Turning to FIG. 16A, an example embodiment of a segment of a cleaning line is shown with a series of spacers. Some or all of the spacers include electronic devices 1601, 1602, 1603 and 1604. Preferrably, the electronic devices are embedded within the spacers so that the cleaning ability and the mechanical ability of the spacers are not affected. The electronic devices may or may not be visible when looking at a given spacer.

The electronic devices may include, for example, sensors, a battery, a communication device, a memory device, a display device, a light, or combinations thereof. Other types of electronic devices may be used according to the principles described herein.

In an example embodiment, one spacer has embedded there within one electronic device, while a different spacer has embedded there within a different electronic device. The electronic devices may in data communication with each other using wired or wireless connections. The electronic devices may also be electrically connected to each other. In an example embodiment, one or more portions of the cable 103 act as a wire to transmit electricity and data between the different electronic devices within the spacers.

In an example embodiment, the electronic device 1601 is a battery that supplies power to the electronic devices 1602 and 1603, which are sensors, and to the electronic device 1604, which is a light. In other words, the electronic devices are distributed amongst the series of spacers. This allows for more computing, sensing, and other capabilities to be included in the form factor of the cleaning apparatus as it operates in a relatively confined space within the tubing.

Figure 16B:
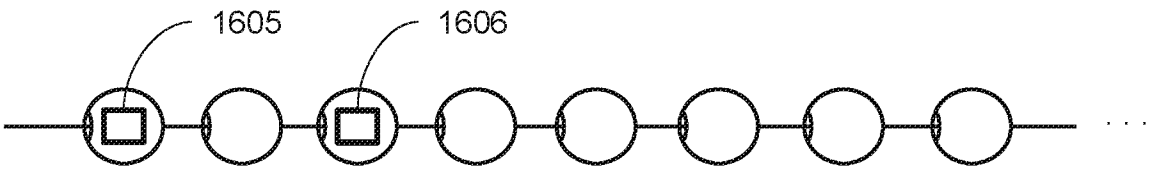
FIG. 16B is a schematic diagram of components within the spacers at a tail portion of the cleaning line according to another example embodiment.

FIG. 16B shows a similar example to FIG. 16A. A tail portion of a cleaning line is shown. One or more spacers positioned at or near the end of the cable include electronic devices 1605 and 1606, such as a sensor and a memory device. The sensor is positioned at the tail end of the cleaning line to assess the effectiveness of the cleaning operation. In other words, after the majority of the cleaning line has passed through the tubing, the sensor is able to determine whether the debris or scaling has been sufficiently removed, or whether additional cleaning is required.

In an example embodiment, the sensors in the one or more spacers include one or multiple ultrasonic transducers that are configured to measure the wall thickness of the tubes. The wall thickness data may be stored in a memory device or may be transmitted, for example, to the controller device. In this way, measurements regarding the wall thickness may be obtained when pulling the cleaning line through the tubing. This data would allow an operator to determine if immediate repair is are required, to estimate when the next maintenance is required, and to estimate the remaining "life" of the tubes.

Other configurations of spacers and electronic devices may be used according to the principles described herein. Other types of electronic devices may also be used according to the principles described herein.

Turning to FIGS. 17A, 17B and 17C, a top view, a side view and a front view of another example embodiment of a spacer 1701 are respectively shown. Multiple instances of these spacers may be strung on a cable 103 and moved through a length of tubing, such as shown in FIGS. 1A and 1B. In other words, this example embodiment of a spacer 1701 may be used with the other features of the systems and methods described herein.

Figure 18:
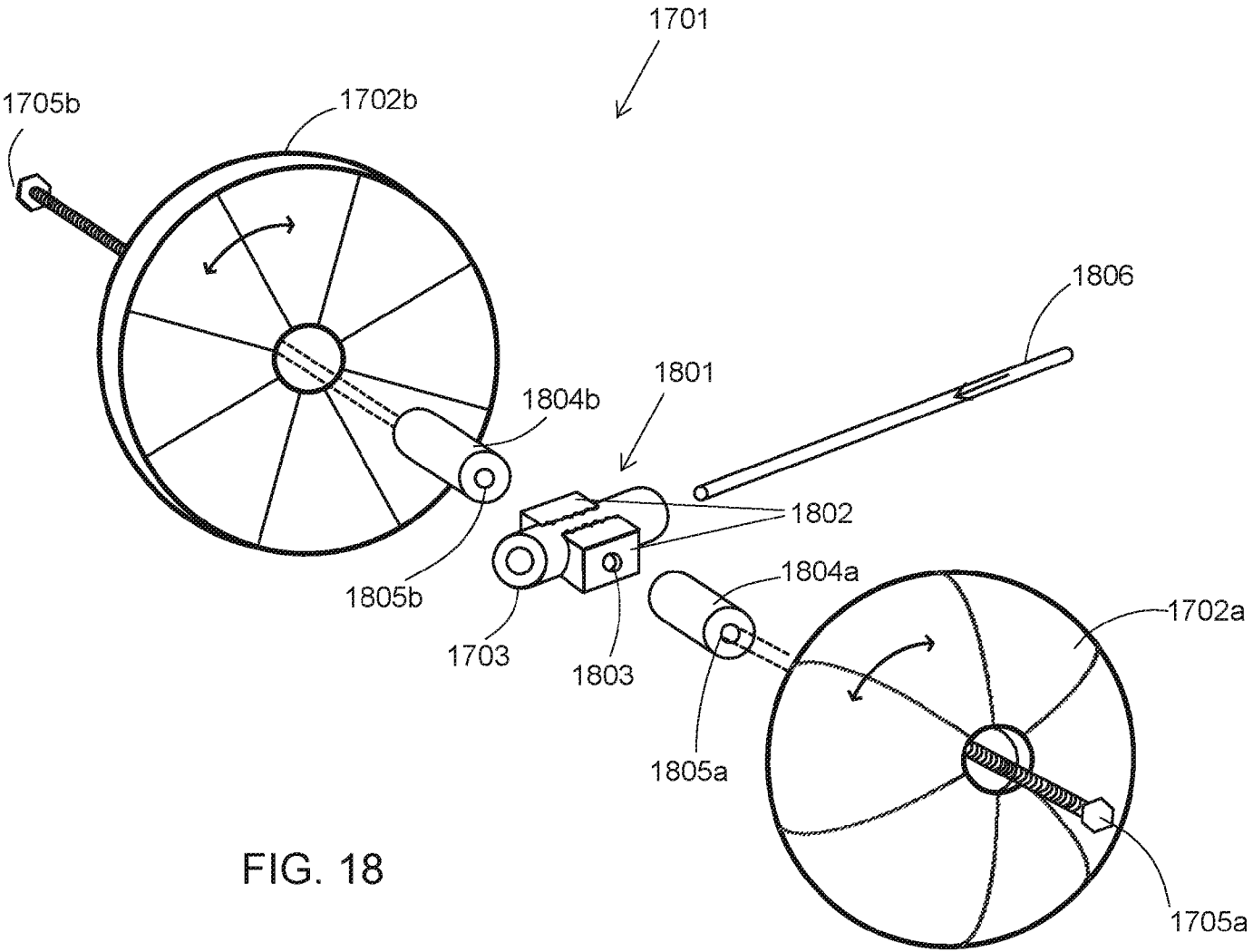
FIG. 18 is an exploded view of another example embodiment of spacer, including a cable to which the spacer is connected.

An exploded view of the spacer 1701 showing its components is illustrated in FIG. 18. The spacer 1701 includes two hemispheres 1702*a* and 1702*b* that are spaced apart from each other by an interior body 1801.

Although the term "hemisphere" is used to describe components 1702*a*, 1702*b* hemisphere 1702*a*, 1702*b*, it will be appreciated that each of these components do not necessarily form half a sphere. For example, these components may form less than or more than half a sphere. These components may also have chamfered or rounded edges, for example, to reduce the risk of a cable being cut or worn down by these components. The exact shape of hemispheres 1702*a* and 1702*b* may differ from what is shown in the figures.

The interior body 1801 includes a cable-receiving portion 1703 and a hemisphere-connector 1802. The cable-receiving portion 1703 includes a hole 1704 extending therethrough, to allow a cable 1806 to pass through the hole 1704. In an example embodiment, the cable-receiving portion 1703 is a tube-like structure.

Hemispheres 1702*a* and 1702*b* are able to rotate independently from each other. Both hemispheres are connected to the interior body 1801, for example, by bolts 1705*a* and 1705*b*, respectively. In an example embodiment, a bearing 1805*a* rests within a hole of the hemisphere 1702*a*, and the bolt 1705*a* passes through a hole 1805*a* in the bearing 1804*a*. The bolt 1705*a* connects to a threaded hole 1803 defined within the hemisphere connector 1802. The bolt 1705*a* secures the bearing 1804*a* and the hemisphere 1702*a* to the interior body 1801.

In operation, the bolt 1705*a* is fixed and the hemisphere 1702*a* rotates around the bearing 1804*a*.

Similarly, the hemisphere 1702*b* rotates around a bearing 1804*b*. The bolt 1705*b* passes through a hole 1805*b* in the bearing 1804*b* and connects to the hemisphere connector 1802. In an example embodiment, the bearings 1804*a*, 1804*b* and the bolts 1705*a*, 1705*b* are aligned with each other on a common axis.

In an example embodiment, the common axis of rotation of the hemispheres is substantially perpendicular to an axis passing through the hole 1704 pf the cable-receiving portion.

Other mechanical configurations for attaching two hemispheres to the interior body, and that allows for rotation of the hemispheres, are applicable to the principles described herein. In a further example aspect, other mechanical configurations that allow for the independent rotation of the hemispheres relative to each other, are applicable to the principles described herein.

In addition to the hemispheres 1702*a* and 1702*b* being able to rotate independently from each other, the entire spacer 1701 is able to rotate about the axis defined by the cable 1806 passing through the hole 1704. In particular, the cable-receiving portion 1703 is able to rotate around the cable passing through its hole 1704.

Figure 19:
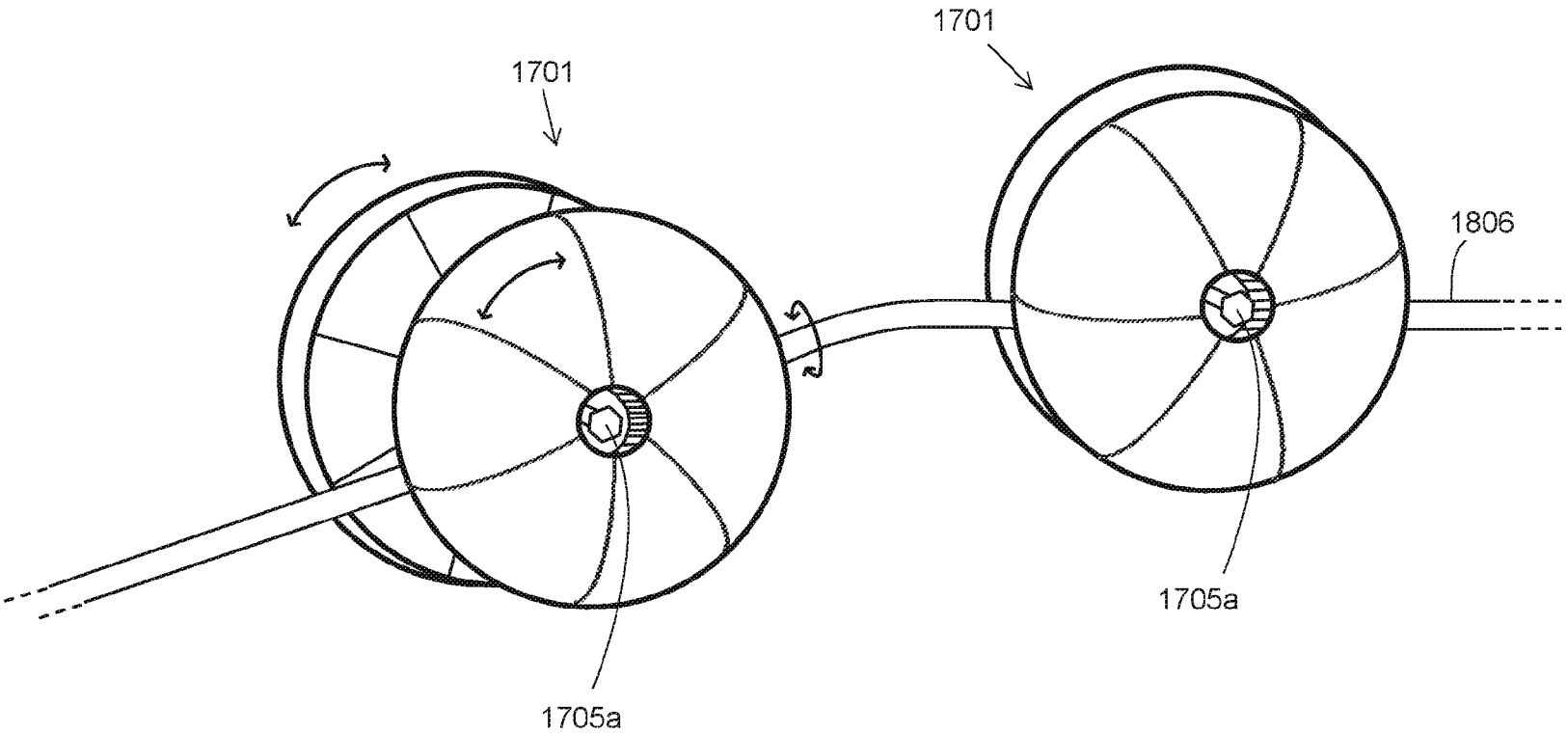
FIG. 19 is another example embodiment of a cleaning line using spacers.

FIG. 19 illustrates two instances of spacers 1701 that show the independent rotations of the hemispheres relative to each other, the spacer itself rotating about the cable. Each spacer may rotate about the cable independently from each other.

Figure 20:
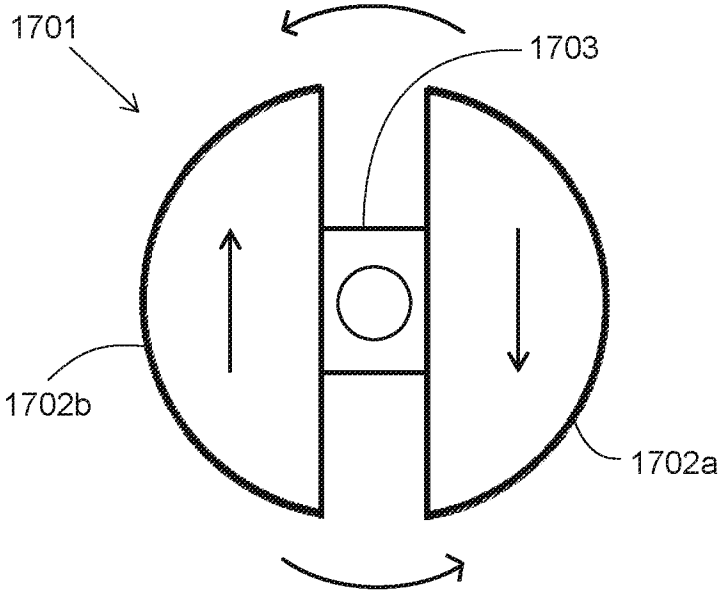
FIG. 20 is a front view of an example embodiment of a spacer, shown in isolation.

FIG. 20 illustrates a spacer 1701 shown in isolation, including the arrow lines to indicate the potential rotation movements.

Figure 21:
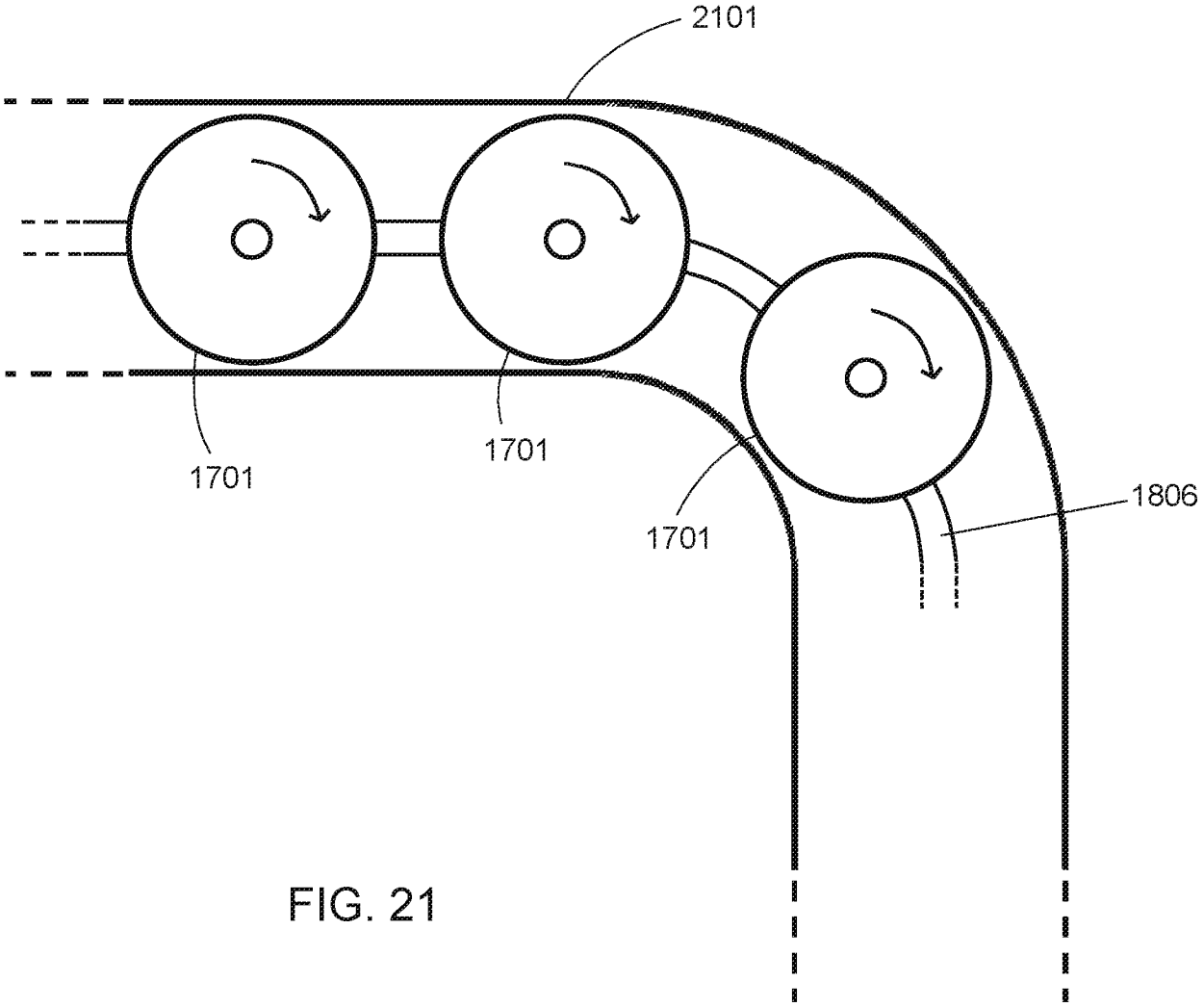
FIG. 21 is an example embodiment of a cleaning line positioned within a tube.

FIG. 21 shows that an assembly of spacers 1701 along a cable 1806, in which the hemispheres rotate while being moved through tubing 2101.

The independent rotation of the hemispheres in each spacer, and the rotating capabilities of each spacer around a cable, reduce the frictional problems when pushing or pulling the spacers through the tubes and bends.

In an example embodiment, each spacer 1701 is fixed to a longitudinal position on the cable using cable crimps or clamps. For example, there are crimps or clamps on opposite ends of each spacer, thus securing a given spacer to a particular longitudinal position on the cable. Other mechanisms of fixing a spacer to the cable, which allows for the rotation of the spacer about the cable, are applicable to the principles described herein.

In an example embodiment, the spacing between these spacers 1701 may vary based on several parameters, such as the diameter of the tubing and the radius of the bends.

Figure 22:
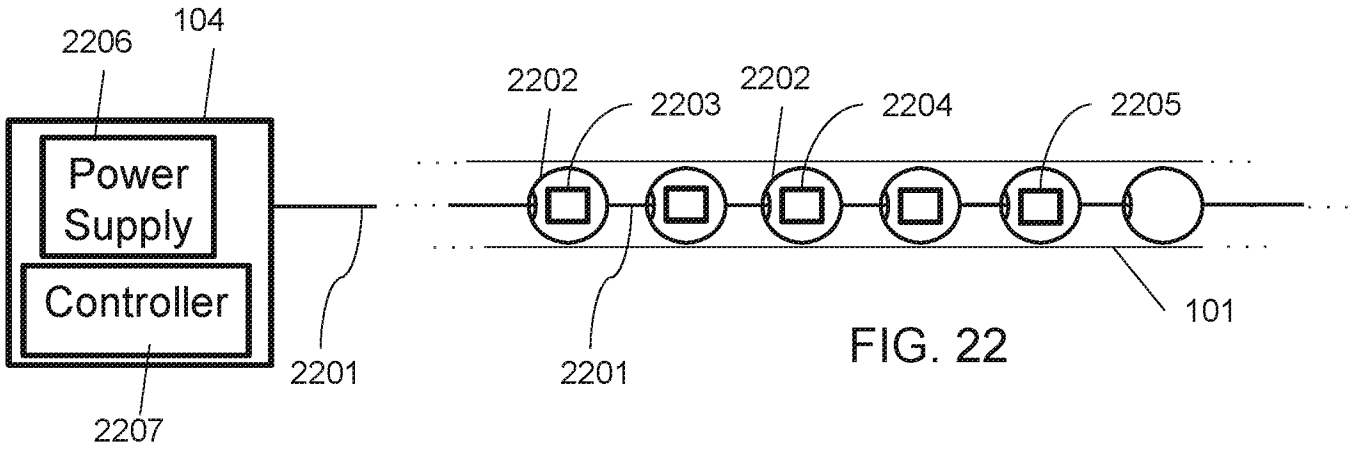
FIG. 22 is a schematic diagram of powered cleaning device components incorporated into the spacers according to an example embodiment.

Turning to FIG. 22, in another example embodiment, one or more of the spacers 2202 have incorporated therein an electrically powered cleaning device 2203, 2204, 2205. The mechanical positioning of the electrically powered cleaning device may vary depending on the cleaning device type.

In an example embodiment, the electrically powered cleaning device is a vibration device or a mechanical agitation device. The vibrations or mechanical agitations help to remove debris on the inner surface of a pipe 101.

For example, the vibration device is an ultrasonic transducer that emits sonic or ultrasonic vibrations. When the spacer is immersed in a liquid or liquid-like material within the pipe, the vibrations are transmitted through the liquid or liquid-like material. These vibrations help to remove or dislodge debris on the inner surface of a pipe, and may also remove clogs. In particular, ultrasonic cleaning uses cavitation bubbles induced by high frequency pressure (sound) waves to agitate a liquid. The agitation produces high forces on contaminants adhering to substrates, such as the inner surface of the pipe. This action also penetrates blind holes, cracks, and recesses.

In another example embodiment, the mechanical agitation device includes a motor (e.g. a rotary motor, a piston motor) that generates vibrations.

It will be appreciated that the powered cleaning device may be effective with and without the presence of a liquid or liquid-like material within the pipe. In particular, one or more certain types of powered cleaning devices may be selected to suit the environment and debris within a pipe.

In another example embodiment, either in addition or in the alternative, the electrically powered cleaning device includes in one or more spacers an energy emitter that is used for cleaning the inner surface of the pipe. For example, the energy emitter is a heat source. In another example, the energy emitter is a microwave emitter. In another example, the energy emitter is a light emitter. In another example, the energy emitter is an ultra-violet light emitter. It will be appreciated that multiple energy emitters of the same type may be incorporated within a given spacer. Different types of emitted energy may have different cleaning effects. For example, heating energy may help with dislodging debris, descaling, disinfecting, or combinations thereof. For example, ultra-violet light may help with disinfecting the inner surface of the pipe.

In another example, different types of energy emitters are incorporated into a given spacer. For example, an ultra-violet light emitter and a heat emitter are incorporated into a given spacer.

In another example embodiment, at least one vibration device and at least one energy emitter are incorporated into a given spacer.

In general, different combinations and permutations of the different types of powered cleaning devices may be incorporated into a given spacer. It will also be appreciated that not all spacers may include a powered cleaning device. Furthermore, different spacers on the same cable 2201 may have different types of powered cleaning devices.

In the example embodiment, as shown in FIG. 22, the line or cable 2201 connecting the spacers 2202 transmits electrical power to the cleaning devices 2203, 2204, 2205 in the spacers.

The line or cable 2201 also transmits and receives, for example, data and control information to and from the cleaning devices. For example, the control information includes activating and deactivating the cleaning devices, or only certain ones of the cleaning devices. The control information also includes, for example, the degree of activation. For example, the frequency and power of a vibration device is controlled based on the control information.

The line or cable is connected to a mover 104, which may further include a power supply 2206 to supply electrical power to the one or more powered cleaning devices. The line or cable may also be in data communication with a controller 2207 located in the mover 104, in order for the controller to transmit data and control information via the line or cable.

In another example embodiment, although not shown, a power supply (e.g. a battery) is incorporated into one or more of the spacers. In other words, the power supply may also be pulled through a pipe via the cable.

It will be appreciated that any module or component exemplified herein that executes instructions may include or otherwise have access to computer readable media such as storage media, computer storage media, or data storage devices (removable and/or non-removable) such as, for example, magnetic disks, optical disks, or tape. Computer storage media may include volatile and non-volatile, removable and non-removable media implemented in any method or technology for storage of information, such as computer readable instructions, data structures, program modules, or other data. Examples of computer storage media include RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by an application, module, or both. Any such computer storage media may be part of the controller device 106 or a mover 104 or accessible or connectable thereto. Any application or module herein described may be implemented using computer readable/executable instructions that may be stored or otherwise held by such computer readable media.

It will be appreciated that different features of the example embodiments of the system, the method and the apparatus, as described herein, may be combined with each other in different ways. In other words, different modules, operations and components may be used together according to other example embodiments, although not specifically stated.

The steps or operations in the flow diagrams described herein are just for example. There may be many variations to these steps or operations without departing from the spirit of the invention or inventions. For instance, the steps may be performed in a differing order, or steps may be added, deleted, or modified.

Although the above has been described with reference to certain specific embodiments, various modifications thereof will be apparent to those skilled in the art without departing from the scope of the claims appended hereto.

The invention claimed is:

1. A cleaning system for inner surfaces of tubing, the system comprising:

a cable with spacers along the length of the cable for insertion into a tube with bends, each of the spacers having a sphere-like body and each of the spacers having at least two surfaces set within the body to define a pair of opposite-facing frusto-conical openings through which the cable passes, and a cleaning apparatus positioned on the cable amongst the spacers;

a first mover configured to pull the cable within the tubing in a first direction;

a second mover configured to pull the cable within the tubing in a second direction, opposite the first direction;

a controller device in communication with both the first mover and the second mover, the controller device comprising memory storing a database, the database comprising at least a first entry that comprises a first point of interest associated with a first specified location within the tubing; and the controller device configured to at least:

activate the first mover to pull the cable and the cleaning apparatus through the tubing;

detect that the cleaning apparatus has passed the first specified location;

activate the second mover to pull the cable and the cleaning apparatus backwards past the first specified location; and activate the first mover to pull the cable and the cleaning apparatus forwards past the first specified location.

2. The cleaning system of claim 1 wherein the first point of interest is a bend in the tubing.

3. The cleaning system of claim 1 wherein the first point of interest is a deposit build-up in the tubing.

4. The cleaning system of claim 1 wherein each of the spacers have a diameter that is approximately the same as an inner diameter of the tubing, and each neighboring pair of spacers are spaced apart from each other at approximately the same distance as the inner diameter of the tubing.

5. The cleaning system of claim 1 wherein the database comprises a second entry that comprises a second point of interest associated with a second specified location within the tubing, and, after the cleaning apparatus has repeatedly passed over the specified location, the controller device is further configured to at least activate the first mover to continue to pull the cable and the cleaning apparatus;

detect that the cleaning apparatus has passed the second specified location;

activate the second mover to pull the cable and the cleaning apparatus backwards past the second specified location; and activate the first mover to pull the cable and the cleaning apparatus forwards past the second specified location.

6. The cleaning system of claim 1 wherein each of the spacers is made of a polyethylene material.

7. The cleaning system of claim 1 wherein each of the spacers and the tubing is made of a same material.

8. The cleaning system of claim 1 wherein the same material is a metal alloy.

9. The cleaning system of claim 1 wherein each of the spacers comprises a first material and a second material embedded within the first material, and wherein a surface of the second material is flush with a surface of the first material.

10. The cleaning system of claim 9 wherein at least one of the first material and the second material is polyethylene and the other one of the first material and the second material is a metal alloy.

11. The cleaning system of claim 10 wherein the second material forms a circumferential band around the body of each of the spacers, and the second material is the metal alloy.

* * * * *